US006247536B1

(12) United States Patent
Leismer et al.

(10) Patent No.: US 6,247,536 B1
(45) Date of Patent: Jun. 19, 2001

(54) DOWNHOLE MULTIPLEXER AND RELATED METHODS

(75) Inventors: Dwayne D. Leismer, Pearland; Thomas G. Hill, Jr., Kingwood; Arthur J. Morris, Magnolia, all of TX (US)

(73) Assignee: Camco International Inc., Houston, TX (US)

( * ) Notice: Subject to any disclaimer, the term of this patent is extended or adjusted under 35 U.S.C. 154(b) by 0 days.

(21) Appl. No.: 09/115,038

(22) Filed: Jul. 14, 1998

(51) Int. Cl.[7] ..... E21B 34/16; E21B 34/14

(52) U.S. Cl. ..... 166/305.1; 166/66.6; 166/320

(58) Field of Search ..... 166/53, 54, 66.6, 166/66.7, 305.1, 320, 332.1, 334.4

(56) References Cited

U.S. PATENT DOCUMENTS

| | | |
|---|---|---|
| 3,371,717 | 3/1968 | Chenoweth . |
| 3,472,070 | 10/1969 | Chenoweth . |
| 3,993,100 | 11/1976 | Pollard et al. . |
| 4,019,592 | 4/1977 | Fox . |
| 4,036,247 | 7/1977 | Baugh . |
| 4,185,541 | 1/1980 | Milberger et al. . |
| 4,271,867 | 6/1981 | Milberger et al. . |
| 4,280,531 | 7/1981 | Milgerger et al. . |
| 4,347,900 | 9/1982 | Barrington . |
| 4,356,841 | 11/1982 | Milberger . |
| 4,378,848 | 4/1983 | Milberger . |
| 4,407,183 | 10/1983 | Milberger et al. . |
| 4,467,833 | 8/1984 | Satterwhite et al. . |
| 4,497,369 | 2/1985 | Hurta et al. . |
| 4,519,263 | 5/1985 | Milberger . |
| 4,549,578 | 10/1985 | Hibbs et al. . |
| 4,596,375 | 6/1986 | Hurta et al. . |
| 4,607,701 | 8/1986 | Gundersen . |
| 4,660,647 | 4/1987 | Richart . |
| 4,945,995 | 8/1990 | Tholance et al. . |
| 5,503,363 | 4/1996 | Wallace . |
| 5,535,767 | 7/1996 | Schnatzmeyer et al. . |
| 5,618,022 | 4/1997 | Wallace . |
| 5,823,263 | 10/1998 | Morris et al. . |
| 5,832,996 | 11/1998 | Carmody et al. . |
| 5,871,200 | 2/1999 | Wallace et al. . |
| 5,957,207 | 9/1999 | Schnatzmeyer . |
| 6,012,518 | 1/2000 | Pringle et al. . |

FOREIGN PATENT DOCUMENTS

| | | |
|---|---|---|
| 0 896 125 A2 | 2/1999 | (EP) . |
| WO 98/39547 | 9/1998 | (WO) . |

OTHER PUBLICATIONS

PROMAC—A Downhole Production Monitoring and Control System, by Smedvig Technologies.

*Primary Examiner*—Frank S. Tsay
(74) *Attorney, Agent, or Firm*—Goldstein & Healey, LLP

(57) ABSTRACT

In a broad aspect, the present invention is a downhole hydraulic multiplexer, which is comprised of one or more piloted shuttle valves, and method of using. The invention takes one or more input signals from a surface control panel or computer, said signals may be electric or hydraulic, and converts said signals into a plurality of pressurized hydraulic output channels. The invention is shown in a variety of preferred embodiments, including a tubing deployed version, a wireline retrievable version, and a version residing in the wall of a downhole completion tool. Also disclosed is the use of multiple shuttle valves used in parallel or in series to embody a downhole hydraulic fluid multiplexer, controllable by and reporting positions of said shuttle valves to said surface control panel or computer.

43 Claims, 20 Drawing Sheets

127
129
125
126
123
122
128
124
130
132

DOWNHOLE MULTIPLEXER AND RELATED METHODS

BACKGROUND OF THE INVENTION

1. Field of the Invention

The present invention relates to subsurface well completion equipment and, more particularly, to apparatus and related methods for using a small number of hydraulic control lines to operate a relatively large number of downhole devices.

2. Description of the Related Art

The late 1990's oil industry is exploring new ways to control hydrocarbon producing wells through a technology known as "Intelligent Well Completions", or "Smart Wells", the definition of which is hereinafter described. Because of hostile conditions inherent in oil wells, and the remote locations of these wells—often thousands of feet below the surface of the ocean and many miles offshore—traditional methods of controlling the operation of downhole devices are severely challenged, especially with regard to electrical control systems. Temperatures may reach 300–400 degrees F. Brines used routinely in well completions are highly electrolytic, and adversely affect electric circuitry if inadvertently exposed thereto. Corrosive elements in wells such as hydrogen sulfide, and carbon dioxide can attack electrical connections, conductors, and insulators and can render them useless over time. While the volume and production rate of hydrocarbons in a subterranean oil reserve may indicate an operational life of twenty or more years, the cost to mobilize the equipment necessary to work over and make repairs to deepwater offshore and subsea wells may run into the tens of millions of dollars. Therefore, a single workover can cost more than the value of the hydrocarbons remaining in the subterranean formation, and as such can result in premature abandonment of the well, and the loss of millions of dollars of hydrocarbons, should problems requiring workover occur.

For these reasons, reliability of systems operating in oil wells is of paramount importance, to the extent that redundancy is required on virtually all critical operational devices. Traditionally, electrical devices used in oil wells are notoriously short lived. Vibration, well chemistry, heat and pressure combine and attack the components and conductors of these electrical devices, rendering them inoperative, sometimes in weeks or months, often in just a year or two. Because of the need for such high levels of reliability, there is a need to reduce the reliance on, or eliminate altogether, electrical control systems in wells. Yet there is a need to control and manage multiple devices and operations in wells with a high degree of reliability.

Well known in the industry is the method of controlling devices in wells utilizing pressurized hydraulic oil in a small diameter control line, extending from a surface pump, through the wellhead, and connecting to a downhole device, such as a surface controlled subsurface safety valve (SCSSV) Such a configuration is shown in U.S. Pat. No. 4,161,219, which is commonly assigned hereto. Pressure applied to the control line opens the SCSSV, and bleeding off said pressure allows the SCSSV to close, blocking the flow of hydrocarbons from the well. Hydraulic control has long been used in this critically important, and highly regulated application because of its high degree of reliability, primarily because: 1) the metallurgy of control lines and its connective fittings have been developed to be resistant to the corrosive elements/conditions in wells; and 2) the hydraulic oils used are essentially incompressible, and are not significantly affected by the wellbore's temperature and pressure.

Well known and for many years in the oil industry, downhole devices are manipulated by wireline (or slickline), whereby the well is taken out of production, the well is "killed" by means of a heavy brine fluid, the wellhead is removed and a lubricator is installed. Wireline tools are inserted in the well through the lubricator and suspended and lowered by a heavy gauge wire to the area of the well where remediation is required. Unfortunately, in the case of subsea wells, wireline operations are difficult in that a ship must be mobilized and moved over the wellhead before said wellhead can be removed, a lubricator installed, and the wireline work begun. As the ocean depth over the well increases, this task becomes exponentially more difficult and expensive.

Another device commonly used in well completions is known as a wellhead. The wellhead is positioned at the uppermost end of the well, and is essentially the junction between the subsurface portion of the well, and the surface portion of the well. In the case of subsea wells, the wellhead sits on the ocean floor. The wellhead's purpose is to contain the hydrocarbons in the well, and direct said hydrocarbons into flow lines for delivery into a transportation system. A common wellhead is shown in U.S. Pat. No. 4,887,672 (Hynes). If hydraulic control lines are to be used downhole, often the operator will specify a number of ports to be built into the wellhead, most commonly one or two. After the wellhead is built it may be difficult or impossible for additional ports to be added to the wellhead, owing to the thickness of the metal, or the proximity to other appurtenances. Additional hydraulic ports can be expensive in any case, and having many additional ports added can be cumbersome.

The definition of "Intelligent Well Completions" or "Smart Wells" is used for a combination of specialized equipment that is placed downhole (below the wellhead), which enables real time reservoir management, downhole sensing of well conditions, and remote control of equipment. Examples of "Intelligent Well Completions" are shown in U.S. Pat. No. 5,207,272 (Pringle et al.), U.S. Pat. No. 5,226,491 (Pringle et al.), U.S. Pat. No. 5,230,383 (Pringle et al.), U.S. Pat. No. 5,236,047 (Pringle et al.), U.S. Pat. No. 5,257,663 (Pringle et al.), U.S. Pat. No. 5,706,896 (Tubel et al.), U.S. patent application Ser. No. 08/638,027, entitled "Method and Apparatus For Remote Control of Multilateral Wells," and U.S. Provisional Patent Application Ser. No. 60/053,620, and are incorporated herein by reference.

In the case of "Intelligent Well Completions," if hydraulic control is the method of choice for the multiplicity for devices in the well, and the hydraulic pressure source emanates from the surface, a large number of ports will be required in the wellhead, and a large number of hydraulic control lines will have to be passed to individual hydraulically actuated components in the wellbore. Hydraulically-actuated components may include SCSSVs, sliding sleeves, locking or latching devices, packers (or packer setting tools), expansion joints, flow control devices, switching devices, safety joints, on/off attachments or artificial lift devices. Of note are advanced gas lift valves, such as the preferred embodiments shown in U.S. Provisional Patent Application Ser. No. 60/023,965. Because so many items in such a well are in need of individual control, the bundle of control lines to perform work in the well can become difficult and unworkable.

Because of the aforementioned problems, there is a need for a hydraulic control system which can control a multiplicity of downhole devices in a well, perform complex operations (usually reserved for workovers) on the fly, without lengthy and expensive well shut-ins, and with a minimum number of control lines from the surface. Further, there is a need to have a system which is resistant to well conditions, and one which will be operationally reliable for many years. There is a need for a system to approximate the computational and operational complexity of electric control systems, with only a few input signals, by use of hydraulic fluid flow, hydraulic fluid pressure oscillation, hydraulic fluid pressure, and proximity sensors to report control valve position, and coupled to a computer at the surface for simplified control and user interface.

SUMMARY OF THE INVENTION

The present invention has been contemplated to overcome the foregoing deficiencies and meet the above described needs. In one aspect, the present invention relates to the independent control of multiple downhole devices from a computer controlled surface panel, using hydraulic pressure, with as few as two hydraulic input lines, or one electric and one hydraulic line from said surface panel feeding through the well head. This invention is essentially a Hydraulic Multiplexer comprised of one or more pilot operated shuttle valves used in parallel, in series, or combinations thereof, and are controlled by pressure oscillation and pressure differential signatures to individually open, shut, or operate individual devices in a well. Position sensing and communication of said pilot operated shuttle valves may be accomplished using proximity sensors of either fiber optic or low voltage electrical technology. This invention will better enable operators of wells that have multiple horizontal or near-horizontal branches, commonly known as multilateral wells, to operate the more complex devices that are inherent in such wells.

In another aspect, the present invention is a downhole hydraulic multiplexer, which is comprised of one or more piloted shuttle valves, and method of using. The invention takes one or more input signals from a surface control panel or computer, said signals may be electric or hydraulic, and converts said signals into a plurality of pressurized hydraulic output channels. The invention is shown in a variety of preferred embodiments, including a tubing deployed version, a wireline retrievable version, and a version residing in the wall of a downhole completion tool. Also disclosed is the use of multiple shuttle valves used in parallel or in series to embody a downhole hydraulic fluid multiplexer, controllable by and reporting positions of said shuttle valves to said surface control panel or computer.

In another aspect, the present invention may be a downhole valve comprising: a valve body having a first fluid inlet port, a second fluid inlet port, and a plurality of fluid outlet ports, the first and second fluid inlet ports being connected to a fluid supply line, the fluid supply line being connected to at least one source of pressurized fluid; a shiftable valve member movably disposed within the valve body in response to pressurized fluid in the fluid supply line; means for holding the position of the shiftable valve member in a plurality of discrete positions relative to the valve body, the shiftable valve member establishing fluid communication between the fluid supply line and one of the plurality of fluid outlet ports for at least one of the plurality of discrete shiftable-valve-member positions; and, means for biasing the shiftable valve member against the pressurized fluid in the fluid supply line. Another feature of this aspect of the present invention may be that the fluid supply line may include a first fluid supply line and a second fluid supply line, the first fluid supply line being connected to the first fluid inlet port, the second fluid supply line being connected to the second fluid inlet port, the shiftable valve member being movable in response to pressurized fluid in the first fluid supply line and establishing fluid communication between the second fluid supply line and one of the plurality of fluid outlet ports for at least one of the plurality of discrete shiftable-valve-member positions, and the biasing means biasing the shiftable valve member against the pressurized fluid in the first fluid supply line. Another feature of this aspect of the present invention may be that pressurized fluid is transferred from the fluid supply line to the plurality of fluid outlet ports through at least one fluid passageway through the shiftable valve member. Another feature of this aspect of the present invention may be that the shiftable valve member includes a plurality of annular recesses for controlling fluid communication between the fluid supply line and the plurality of fluid outlet ports. Another feature of this aspect of the present invention may be that the holding means includes a plurality of notches on the shiftable valve member for mating with a retaining member connected to the valve body. Another feature of this aspect of the present invention may be that the retaining member is a spring-loaded detent ball. Another feature of this aspect of the present invention may be that the retaining member is a collet finger. Another feature of this aspect of the present invention may be that the holding means includes a plurality of notches about an inner bore of the valve member for mating with a retaining member connected to the shiftable valve member. Another feature of this aspect of the present invention may be that the retaining member is a spring-loaded detent ball. Another feature of this aspect of the present invention may be that the retaining member is a collet finger. Another feature of this aspect of the present invention may be that the holding means includes a cammed indexer for mating with a retaining member connected to the valve body. Another feature of this aspect of the present invention may be that the retaining member is a spring-loaded detent pin. Another feature of this aspect of the present invention may be that the valve body further includes a plurality of fluid exhaust ports, the shiftable valve member establishing fluid communication between at least one of the plurality of fluid outlet ports and at least one of the plurality of fluid exhaust ports for at least one of the plurality of discrete shiftable-valve-member positions. Another feature of this aspect of the present invention may be that the valve may further include at least one check valve for restricting fluid flow from a well annulus into the plurality of exhaust ports. Another feature of this aspect of the present invention may be that the valve may further include at least one pressure relief valve. Another feature of this aspect of the present invention may be that the valve may further include at least one filter for preventing debris in a well annulus from entering the plurality of exhaust ports. Another feature of this aspect of the present invention may be that the biasing means includes a spring. Another feature of this aspect of the present invention may be that the biasing means includes a gas chamber. Another feature of this aspect of the present invention may be that the valve body further includes a charging port for supplying pressurized gas to the gas chamber. Another feature of this aspect of the present invention may be that the biasing means includes a spring and a gas chamber. Another feature of this aspect of the present invention may be that the biasing means includes a balance line. Another feature of this aspect of the present invention may be that the balance line is connected to a remote source of pressurized fluid. Another feature of this aspect of the present invention may be that the biasing means includes a balance line connected to the second fluid supply line to bias the shiftable valve member against the pressurized fluid in the first fluid supply line. Another feature of this aspect of the present invention may be that the balance line further includes a pressure relief valve. Another feature of this aspect of the present invention may be that the balance line further includes a choke and a accumulator. Another feature of this aspect of the present invention may be that the valve may further include a synchronizer at the earth's surface for monitoring and processing the number of hydraulic pulses applied to the downhole valve through the fluid supply line to provide an indication of the position of the shiftable valve member. Another feature of this aspect of the present invention may be that the shiftable valve member further includes a longitudinal bore therethrough having a pressure equalizing valve disposed therein. Another feature of this aspect of the present invention may be that the valve may further include at least one proximity sensor connected to a conductor for transmitting a signal to a remote control panel to indicate the position of the shiftable valve member. Another feature of this aspect of the present invention may be that the valve is tubing-deployed. Another feature of this aspect of the present invention may be that the valve is wireline-retrievable.

In another aspect, the present invention may be a downhole valve comprising: a valve body having a first fluid inlet port, a second fluid inlet port, and a plurality of fluid outlet ports, the first and second fluid inlet ports being connected to a fluid supply line, the fluid supply line being connected to at least one source of pressurized fluid; a shiftable valve member having a plurality of notches, at least one fluid passageway establishing fluid communication between the fluid supply line and the plurality of fluid outlet ports, and being movably disposed within the valve body in response to pressurized fluid in the fluid supply line; a retaining member on the valve body and cooperating with the plurality of notches on the shiftable valve member to hold the position of the shiftable valve member in a plurality of discrete positions, the shiftable valve member establishing fluid communication between the fluid supply line and one of the plurality of fluid outlet ports for at least one of the plurality of discrete shiftable-valve-member positions; and, a spring biasing the shiftable valve member against the pressurized fluid in the fluid supply line. Another feature of this aspect of the present invention may be that the fluid supply line includes a first fluid supply line and a second fluid supply line, the first fluid supply line being connected to the first fluid inlet port, the second fluid supply line being connected to the second fluid inlet port, the at least one fluid passageway establishing fluid communication between the second fluid supply line and the plurality of fluid outlet ports, the shiftable valve member being movable in response to pressurized fluid in the first fluid supply line and establishing fluid communication between the second fluid supply line and one of the plurality of fluid outlet ports for at least one of the plurality of discrete shiftable-valve-member positions, and the spring biasing the shiftable valve member against the pressurized fluid in the first fluid supply line. Another feature of this aspect of the present invention may be that the at least one fluid passageway includes a plurality of annular recesses disposed about the shiftable valve member. Another feature of this aspect of the present invention may be that the retaining member is a spring-loaded detent ball. Another feature of this aspect of the present invention may be that the retaining member is a collet finger. Another feature of this aspect of the present invention may be that the valve body further includes a plurality of fluid exhaust ports, the shiftable valve member establishing fluid communication between at least one of the plurality of fluid outlet ports and at least one of the plurality of fluid exhaust ports for at least one of the plurality of discrete shiftable-valve-member positions. Another feature of this aspect of the present invention may be that the valve may further include at least one check valve for restricting fluid flow from a well annulus into the plurality of exhaust ports. Another feature of this aspect of the present invention may be that the valve may further include at least pressure relief valve. Another feature of this aspect of the present invention may be that the valve may further include at least one filter for preventing debris in a well annulus from entering the plurality of exhaust ports. Another feature of this aspect of the present invention may be that the valve may further include at least one proximity sensor connected to a conductor for transmitting a signal to a remote control panel to indicate the position of the shiftable valve member. Another feature of this aspect of the present invention may be that the at least one proximity sensor is a fiber optic sensor and the conductor is a fiber optic conductor cable. Another feature of this aspect of the present invention may be that the at least one proximity sensor is a magnetic sensor and the conductor is a low voltage electrical insulated cable. Another feature of this aspect of the present invention may be that the valve may further include a gas chamber containing a volume of pressurized gas biasing the shiftable valve member against the pressurized fluid in the fluid supply line. Another feature of this aspect of the present invention may be that the shiftable valve member further includes a longitudinal bore therethrough having a pressure equalizing valve disposed therein. Another feature of this aspect of the present invention may be that the valve may further include a balance line to assist the spring in biasing the shiftable valve member against the pressurized fluid in the fluid supply line. Another feature of this aspect of the present invention may be that the balance line is connected to a remote source of pressurized fluid. Another feature of this aspect of the present invention may be that the valve may further include a balance line connected to the second fluid supply line to assist the spring in biasing the shiftable valve member against the pressurized fluid in the first fluid supply line. Another feature of this aspect of the present invention may be that the balance line further includes a pressure relief valve. Another feature of this aspect of the present invention may be that the balance line further includes a choke and a accumulator. Another feature of this aspect of the present invention may be that the valve may further include a synchronizer at the earth's surface for monitoring and processing the number of hydraulic pulses applied to the downhole valve through the fluid supply line to provide an indication of the position of the shiftable valve member. Another feature of this aspect of the present invention may be that the valve is tubing-deployed. Another feature of this aspect of the present invention may be that the valve is wireline-retrievable.

In another aspect, the present invention may be a downhole valve comprising: a valve body having a first fluid inlet port, a second fluid inlet port, and a plurality of fluid outlet ports, the first and second fluid inlet ports being connected to a fluid supply line, the fluid supply line being connected to at least one source of pressurized fluid; a shiftable valve member having a plurality of notches, at least one fluid passageway establishing fluid communication between the fluid supply line and the plurality of fluid outlet ports, and being movably disposed within the valve body in response to pressurized fluid in the fluid supply line; a retaining member on the valve body and cooperating with the plurality of notches on the shiftable valve member to hold the position of the shiftable valve member in a plurality of discrete positions, the shiftable valve member establishing fluid communication between the fluid supply line and one of the plurality of fluid outlet ports for at least one of the plurality of discrete shiftable-valve-member positions; and, a gas chamber containing a volume of pressurized gas biasing the shiftable valve member against the pressurized fluid in the fluid supply line. Another feature of this aspect of the present invention may be that the fluid supply line includes a first fluid supply line and a second fluid supply line, the first fluid supply line being connected to the first fluid inlet port, the second fluid supply line being connected to the second fluid inlet port, the at least one fluid passageway establishing fluid communication between the second fluid supply line and the plurality of fluid outlet ports, the shiftable valve member being movable in response to pressurized fluid in the first fluid supply line and establishing fluid communication between the second fluid supply line and one of the plurality of fluid outlet ports for at least one of the plurality of discrete shiftable-valve-member positions, and the gas chamber biasing the shiftable valve member against the pressurized fluid in the first fluid supply line. Another feature of this aspect of the present invention may be that the at least one fluid passageway includes a plurality of annular recesses disposed about the shiftable valve member. Another feature of this aspect of the present invention may be that the retaining member is a spring-loaded detent ball. Another feature of this aspect of the present invention may be that the retaining member is a collet finger. Another feature of this aspect of the present invention may be that the valve body further includes a plurality of fluid exhaust ports, the shiftable valve member establishing fluid communication between at least one of the plurality of fluid outlet ports and at least one of the plurality of fluid exhaust ports for at least one of the plurality of discrete shiftable-valve-member positions. Another feature of this aspect of the present invention may be that the valve may further include at least one check valve for restricting fluid flow from a well annulus into the plurality of exhaust ports. Another feature of this aspect of the present invention may be that the valve may further include at least pressure relief valve. Another feature of this aspect of the present invention may be that the valve may further include at least one filter for preventing debris in a well annulus from entering the plurality of exhaust ports. Another feature of this aspect of the present invention may be that the valve may further include at least one proximity sensor connected to a conductor for transmitting a signal to a remote control panel to indicate the position of the shiftable valve member. Another feature of this aspect of the present invention may be that the at least one proximity sensor is a fiber optic sensor and the conductor is a fiber optic conductor cable. Another feature of this aspect of the present invention may be that the at least one proximity sensor is a magnetic sensor and the conductor is a low voltage electrical insulated cable. Another feature of this aspect of the present invention may be that the valve body further includes a charging port for supplying pressurized gas to the gas chamber. Another feature of this aspect of the present invention may be that the charging port includes a dill core valve. Another feature of this aspect of the present invention may be that the gas chamber further includes a viscous fluid between the pressurized gas and the shiftable valve member. Another feature of this aspect of the present invention may be that the valve may further include a spring biasing the shiftable valve member against the pressurized fluid in the fluid supply line. Another feature of this aspect of the present invention may be that the shiftable valve member further includes a longitudinal bore therethrough having a pressure equalizing valve disposed therein. Another feature of this aspect of the present invention may be that the valve may further include a balance line to assist the gas chamber in biasing the shiftable valve member against the pressurized fluid in the fluid supply line. Another feature of this aspect of the present invention may be that the balance line is connected to a remote source of pressurized fluid. Another feature of this aspect of the present invention may be that the valve may further include a balance line connected to the second fluid supply line to assist the spring in biasing the shiftable valve member against the pressurized fluid in the first fluid supply line. Another feature of this aspect of the present invention may be that the balance line further includes a pressure relief valve. Another feature of this aspect of the present invention may be that the balance line further includes a choke and a accumulator. Another feature of this aspect of the present invention may be that the valve may further include a synchronizer at the earth's surface for monitoring and processing the number of hydraulic pulses applied to the downhole valve through the fluid supply line to provide an indication of the position of the shiftable valve member. Another feature of this aspect of the present invention may be that the valve is tubing-deployed. Another feature of this aspect of the present invention may be that the valve is wireline-retrievable.

In another aspect, the present invention may be a downhole valve comprising: a valve body having a first fluid inlet port, a second fluid inlet port, a plurality of fluid outlet ports, and a retaining member, the first and second fluid inlet ports being connected to a fluid supply line, the fluid supply line being connected to at least one source of pressurized fluid; a piston movably disposed within the valve body, a first end of the piston being in fluid communication with the fluid supply line and moveable in response to pressurized fluid therein; a position holder movably disposed within the valve body, connected to the piston, and engaged with the retaining member; a fluid transfer member movably disposed within the valve body and having at least one fluid passageway, the fluid transfer member being connected to the piston and the position holder, the position holder and the retaining member cooperating to maintain the fluid transfer member in a plurality of discrete positions, the at least one fluid passageway establishing fluid communication between the fluid supply line and one of the plurality of fluid outlet ports for at least one of the plurality of discrete fluid-transfer-member positions; and, a return means for biasing the piston against the pressurized fluid in the fluid supply line. Another feature of this aspect of the present invention may be that the fluid supply line includes a first fluid supply line and a second fluid supply line, the first fluid supply line being connected to the first fluid inlet port, the second fluid supply line being connected to the second fluid inlet port, the first end of the piston being in fluid communication with the first fluid supply line and moveable in response to pressurized fluid therein, the at least one fluid passageway establishing fluid communication between the second fluid supply line and one of the plurality of fluid outlet ports for at least one of the plurality of discrete fluid-transfer-member positions, and the return means biasing the piston against the pressurized fluid in the first fluid supply line. Another feature of this aspect of the present invention may be that the fluid transfer member includes a plurality of fluid passageways, and the valve body further includes a plurality of fluid exhaust ports, at least one of which is in fluid communication through one of the plurality of fluid passageways with one of the fluid outlet ports, other than the fluid outlet port in fluid communication with the fluid supply line, for at least one of the plurality of discrete fluid-transfer-member positions. Another feature of this aspect of the present invention may be that at least one of the plurality of fluid exhaust ports further includes a one-way check valve. Another feature of this aspect of the present invention may be that at least one of the plurality of fluid exhaust ports further includes a pressure relief valve. Another feature of this aspect of the present invention may be that at least one of the plurality of fluid exhaust ports further includes a filter. Another feature of this aspect of the present invention may be that the valve may further include at least one proximity sensor connected to a conductor for transmitting a signal to a remote control panel to indicate a position of the fluid transfer member. Another feature of this aspect of the present invention may be that the at least one proximity sensor is a fiber optic sensor and the conductor is a fiber optic conductor cable. Another feature of this aspect of the present invention may be that the at least one proximity sensor is a magnetic sensor and the conductor is a low voltage electrical insulated cable. Another feature of this aspect of the present invention may be that the valve may further include a pressure transducer connected to a conductor cable, the conductor cable transmitting a signal to a control panel, the signal representing the pressure of fluid within the first fluid supply line, the pressure signal indicating which of the plurality of fluid outlet ports is in fluid communication with the fluid supply line. Another feature of this aspect of the present invention may be that the transducer is a fiber optic pressure transducer and the conductor cable is a fiber optic cable. Another feature of this aspect of the present invention may be that the return means includes a spring. Another feature of this aspect of the present invention may be that the valve may further include a gas chamber containing a volume of pressurized gas biasing the piston against the pressurized fluid in the fluid supply line. Another feature of this aspect of the present invention may be that the piston further includes a longitudinal bore therethrough having a pressure equalizing valve disposed therein. Another feature of this aspect of the present invention may be that the valve body further includes a charging port for supplying pressurized gas to the gas chamber. Another feature of this aspect of the present invention may be that the return means includes a balance line. Another feature of this aspect of the present invention may be that the balance line is connected to a remote source of pressurized fluid. Another feature of this aspect of the present invention may be that the return means includes a balance line connected to the second fluid supply line to bias the piston against the pressurized fluid in the first fluid supply line. Another feature of this aspect of the present invention may be that the balance line further includes a pressure relief valve. Another feature of this aspect of the present invention may be that the balance line further includes a choke and a accumulator. Another feature of this aspect of the present invention may be that the valve may further include a synchronizer at the earth's surface for monitoring and processing the number of hydraulic pulses applied to the downhole valve through the fluid supply line to provide an indication of the position of the shiftable valve member. Another feature of this aspect of the present invention may be that the retaining member is a spring-loaded detent pin. Another feature of this aspect of the present invention may be that the retaining member is a collet finger. Another feature of this aspect of the present invention may be that the retaining member is a hook hingedly attached to the valve body about a pin and biased into engagement with the position holder by a spring. Another feature of this aspect of the present invention may be that the piston, the position holder, and the fluid transfer member are an integral component. Another feature of this aspect of the present invention may be that the fluid transfer member is a shuttle valve. Another feature of this aspect of the present invention may be that the at least one fluid passageway through the fluid transfer member is a longitudinal bore through the fluid transfer member that is in fluid communication with an axial bore in the fluid transfer member. Another feature of this aspect of the present invention may be that the fluid transfer member is fixedly connected to the position holder, whereby longitudinal movement of the piston will cause longitudinal and angular movement of the fluid transfer member. Another feature of this aspect of the present invention may be that the fluid transfer member is rotatably connected to the position holder, whereby longitudinal movement of the piston will cause only longitudinal movement of the fluid transfer member. Another feature of this aspect of the present invention may be that the valve is tubing-deployed. Another feature of this aspect of the present invention may be that the valve is wireline-retrievable.

In another aspect, the invention may be a downhole valve comprising: a valve body having a fluid inlet port connected to a fluid supply line connected to a source of pressurized fluid, and a plurality of fluid outlet ports; a motor disposed within the valve body, the motor being connected to an electrical conductor connected to a source of electricity; a linear actuator connected to the motor and moveable in response to actuation of the motor; and a fluid transfer member movably disposed within the valve body and having at least one fluid passageway, the fluid transfer member being connected to the linear actuator, the linear actuator being moveable to maintain the fluid transfer member in a plurality of discrete positions, the at least one fluid passageway in the fluid transfer member establishing fluid communication between the fluid supply line and one of the plurality of fluid outlet ports for at least one of the plurality of discrete fluid-transfer-member positions. Another feature of this aspect of the present invention may be that the fluid transfer member includes a plurality of fluid passageways, and the valve body further includes a plurality of fluid exhaust ports, at least one of which is in fluid communication through one of the plurality of fluid passageways with one of the fluid outlet ports, other than the fluid outlet port in fluid communication with the fluid supply line, for at least one of the plurality of discrete fluid-transfer-member positions. Another feature of this aspect of the present invention may be that the fluid transfer member is a shuttle valve. Another feature of this aspect of the present invention may be that the valve is tubing-deployed. Another feature of this aspect of the present invention may be that the valve is wireline-retrievable. Another feature of this aspect of the present invention may be that the at least one fluid passageway through the fluid transfer member is a longitudinal bore through the fluid transfer member that is in fluid communication with an axial bore in the fluid transfer member. Another feature of this aspect of the present invention may be that the motor is a stepper motor. Another feature of this aspect of the present invention may be that the valve may further include a step counter connected to the motor and to the electrical control line. Another feature of this aspect of the present invention may be that the linear actuator is a threaded rod threadably connected to the fluid transfer member, rotation of the threaded rod causing movement of the fluid transfer member. Another feature of this aspect of the present invention may be that the valve may further include a rotary variable differential transformer connected to the motor and to the electrical control line. Another feature of this aspect of the present invention may be that the motor, the linear actuator, and the rotary variable differential transformer are an integral unit. Another feature of this aspect of the present invention may be that the valve may further include an electronic module connected between the electrical cable and the motor to control operation of the motor. Another feature of this aspect of the present invention may be that the valve may further include an electromagnetic tachometer connected to the motor and to the electrical control line. Another feature of this aspect of the present invention may be that the valve may further include an electric resolver connected to the motor and to the electrical control line. Another feature of this aspect of the present invention may be that the fluid transfer member includes a plurality of annular recesses for controlling fluid communication between the fluid supply line and the plurality of fluid outlet ports.

In another aspect, the present invention may be a well completion comprising: a surface control panel having at least one source of pressurized fluid; a production tubing connected to a downhole valve means and a plurality of pressure-actuated downhole well tools; a fluid supply line connected to the at least one source of pressurized fluid and to the downhole valve means, the downhole valve means being remotely controllable in response to pressurized fluid in the fluid supply line to selectively establish fluid communication between the fluid supply line and the plurality of downhole well tools. Another feature of this aspect of the present invention may be that the downhole valve means is located within a sidewall of one of the plurality of downhole well tools. Another feature of this aspect of the present invention may be that the downhole valve means is retrievably located within a side pocket mandrel connected to the production tubing. Another feature of this aspect of the present invention may be that the completion may further include means on the downhole valve means for establishing two-way communication between the downhole valve means and the surface control panel. Another feature of this aspect of the present invention may be that two-way communication is electrically established between the downhole valve means and the surface control panel. Another feature of this aspect of the present invention may be that two-way communication is fiber-optically established between the downhole valve means and the surface control panel.

In another aspect, the present invention may be a well completion comprising: a surface control panel having at least one source of pressurized fluid; a first and second surface controlled subsurface safety valve connected to a production tubing; multiplexer means connected to the production tubing for remotely and selectively establishing fluid communication between the at least one source of pressurized fluid and the first and second safety valves to independently satisfy each of the following four conditions: (a) simultaneously holding the first and second safety valves open; (b) simulataneously holding the first and second safety valves closed; (c) simulataneously holding the first safety valve open and the second safety valve closed; and (d) simulataneously holding the first safety valve closed and the second safety valve open.

In another aspect, the present invention may be a downhole well control system comprising: a surface control panel having at least one source of pressurized fluid; afirst fluid supply line connected to the at least one source of pressurized fluid; a second fluid supply line connected to the at least one source of pressurized fluid; a plurality of pressure-actuated downhole well tools; and a plurality of downhole valve means, at least one of the plurality of downhole valve means being connected to the first and second fluid supply lines, the at least one downhole valve means being remotely controllable in response to pressurized fluid in the first fluid supply line to selectively establish fluid communication between the second fluid supply line apply and another of the plurality of downhole valve means and at least one of the plurality of downhole well tools.

In another aspect, the present invention may be a system for remotely and selectively injecting corrosion inhibiting chemicals into multiple production zones in a well having multiple lateral well bores, the system comprising: a downhole valve means connected to a production tubing and having a first fluid inlet port, a second fluid inlet port, and a plurality of fluid outlet ports, the first and second fluid inlet ports being connected to a fluid supply line, the fluid supply line being connected to a source of corrosion inhibiting chemicals; a plurality of packers connected to the production tubing and establishing a plurality of production zones associated with corresponding lateral well bores in the well; a plurality of flow control devices connected to the production tubing, each of the production zones having one of the plurality of flow control devices disposed therein; and, a plurality of chemical injection conduits establishing fluid communication between the plurality of fluid outlet ports on the downhole valve means and each of the production zones.

In another aspect, the present invention may be a method of controlling a plurality of pressure-actuated downhole well tools comprising the steps of: connecting a first fluid supply line from at least one source of pressurized fluid to a downhole valve; connecting a second fluid supply line from the at least one source of pressurized fluid to the downhole valve; and, applying pressure through the first fluid supply line to the downhole valve means to selectively establish fluid communication between the second fluid supply line apply and a plurality of downhole well tools.

Figure 1:
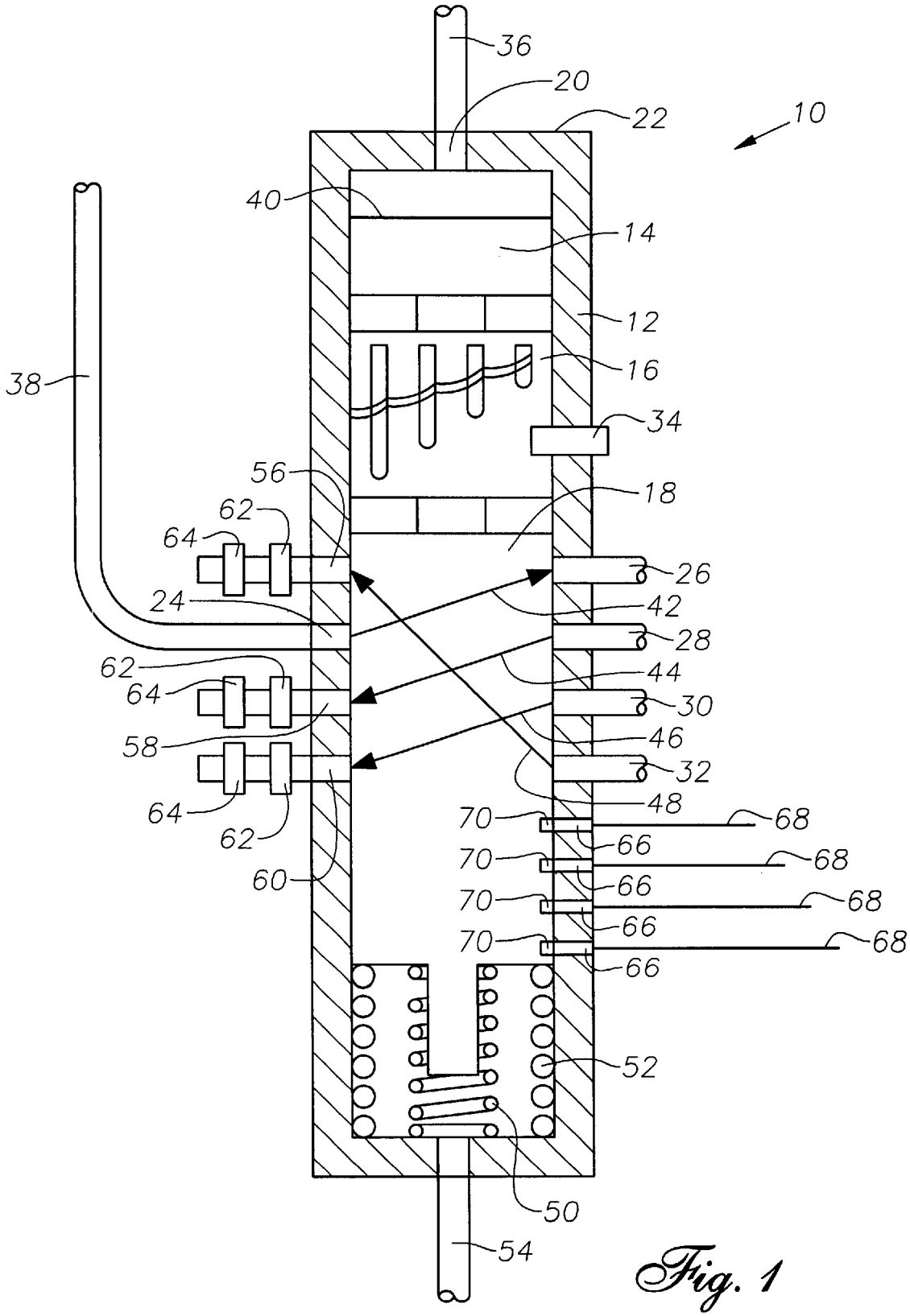
FIG. 1 is a partial schematic representation of a specific embodiment of a downhole valve of the present invention, shown in a first position.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE INVENTION

In the description which follows, like parts are marked throughout the specification and drawings with the same reference numerals, respectively. The Figures are not necessarily drawn to scale, and in some instances, have been exaggerated or simplified to clarify certain features of the invention. One skilled in the art will appreciate many differing applications of the described apparatus.

For the purposes of this discussion, the terms "upper" and "lower," "up hole" and "downhole," and "upwardly" and "downwardly" are relative terms to indicate position and direction of movement in easily recognized terms. Usually, these terms are relative to a line drawn from an upmost position at the surface to a point at the center of the earth, and would be appropriate for use in relatively straight, vertical wellbores. However, when the wellbore is highly deviated, such as from about 60 degrees from vertical, or horizontal these terms do not make sense and therefore should not be taken as limitations. These terms are only used for ease of understanding as an indication of what the position or movement would be if taken within a vertical wellbore.

Referring to FIGS. 1–4, there is shown a specific embodiment of a downhole valve 10 of the present invention. As shown in FIG. 1, this embodiment of the present invention may broadly comprise a valve body 12, a piston 14, a piston holder 16, and a fluid transfer member 18. In a specific embodiment, the valve body 12 may include a first fluid inlet port 20 adjacent a first end 22 of the valve body 12, a second fluid inlet port 24, a plurality of fluid outlet ports 26–32, and a retaining member 34. In this specific embodiment, the valve body 12 includes a first fluid outlet port 26, a second fluid outlet port 28, a third fluid outlet port 30, and a fourth fluid outlet port 32. The valve 10 is shown with four fluid outlet ports 26–32 for purposes of illustration only. The present invention is not intended to be limited to any particular number of fluid outlet ports, but, instead, is intended to encompass any number of fluid outlet ports. The first fluid inlet port 20 is connected to a first fluid supply line 36 that is connected to at least one source of pressurized fluid (not shown), and the second fluid inlet port 24 is connected to the second fluid supply line 38 that is connected to the at least one source of pressurized fluid (not shown). The first and second fluid inlet ports 20 and 24 may be supplied with pressurized fluid from one or more fluid supply lines running from the earth's surface. In the event only one fluid supply line extends from the earth's surface to the valve body 12, that single fluid supply line is branched into two separate lines at a point near the valve body; one of the lines is connected to the first inlet port 20 and one is connected to the second inlet port 24. As such, in a specific embodiment, the first fluid supply line 36 and the second fluid supply line 38 may each extend from the valve body 12 to the earth's surface. In another specific embodiment, only one of the first and second fluid supply lines 36 and 38 extends from the valve body 12 to the earth's surface, and the other of the first and second fluid supply lines 36 and 38 extends from the valve body 12 to the only one of the first and second fluid supply lines 36 and 38 extending to the earth's surface and is in fluid communication therewith. The piston 14 is movably disposed within the valve body 12. A first end 40 of the piston is in fluid communication with the first fluid supply line 36 and is moveable in response to pressurized fluid therein.

Figure 5:
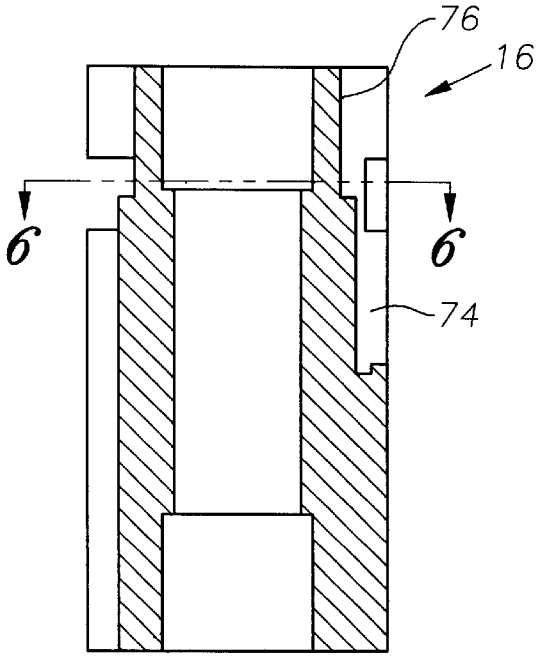
FIG. 5 is a cross-sectional side view of a specific embodiment of a cammed indexer of the present invention.
Figure 6:
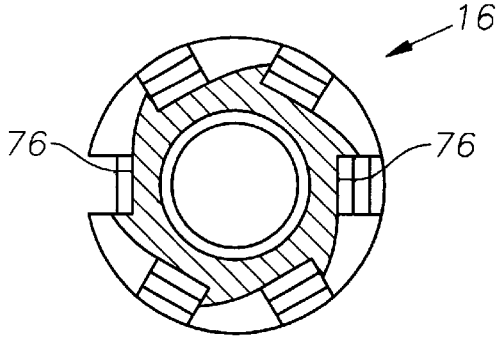
FIG. 6 is a cross-sectional view taken along line 6—6 of FIG. 5.
Figure 7:
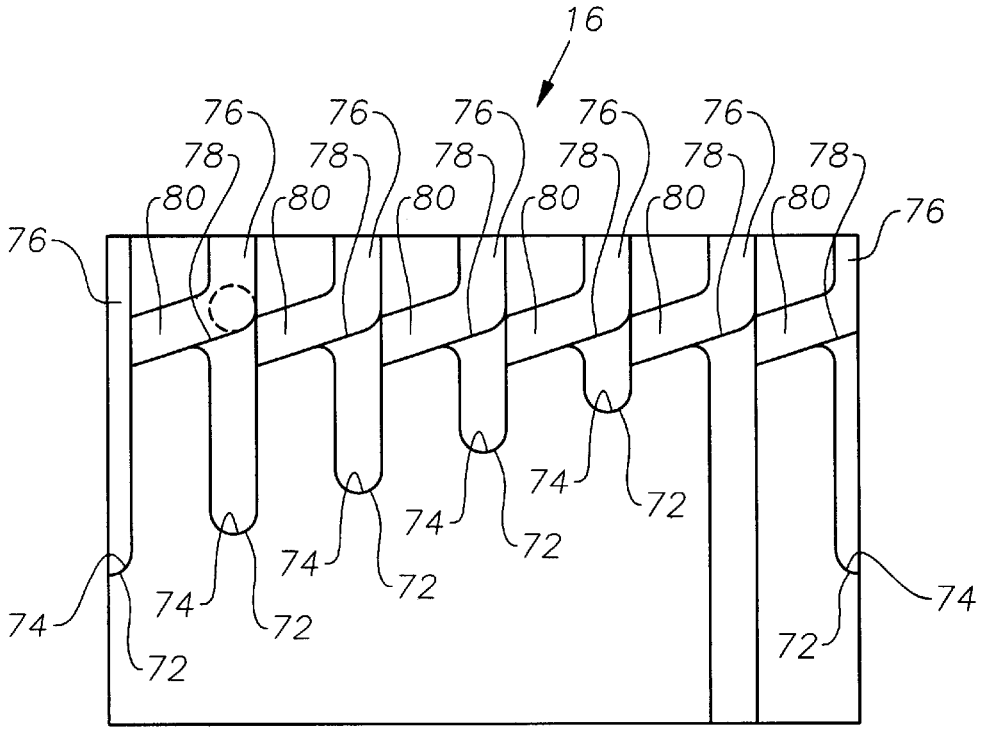
FIG. 7 is a planar projection of the outer cylindrical surface of the cammed indexer shown in FIGS. 5 and 6.
Figure 8:
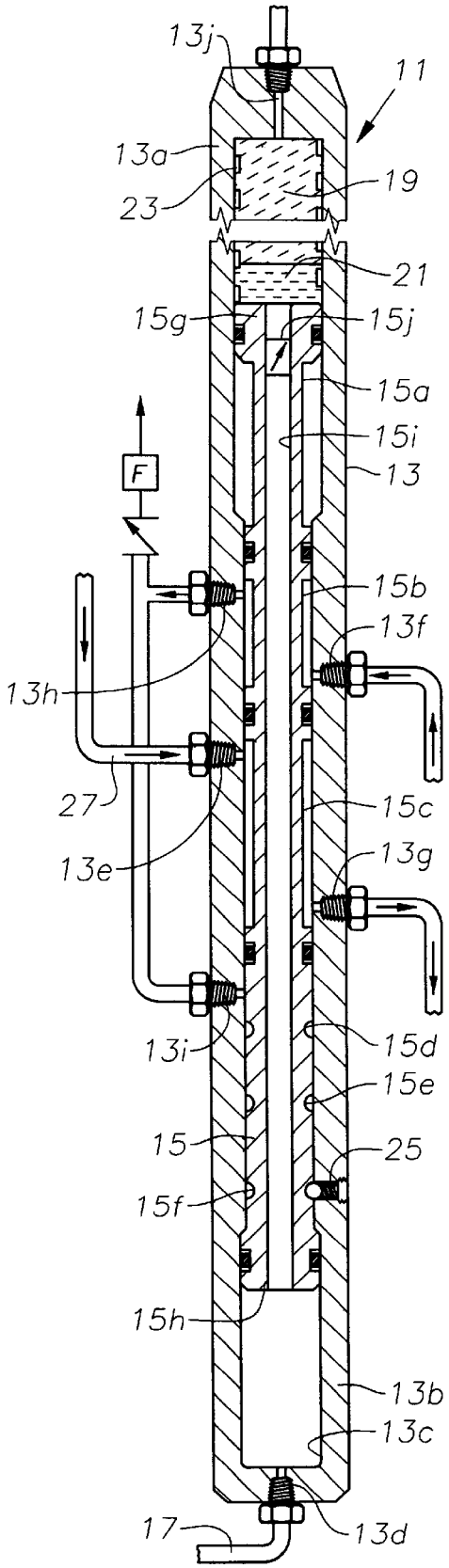
FIG. 8 is a side elevation view of another specific embodiment of a downhole valve of the present invention, shown in a first position.
Figure 9:
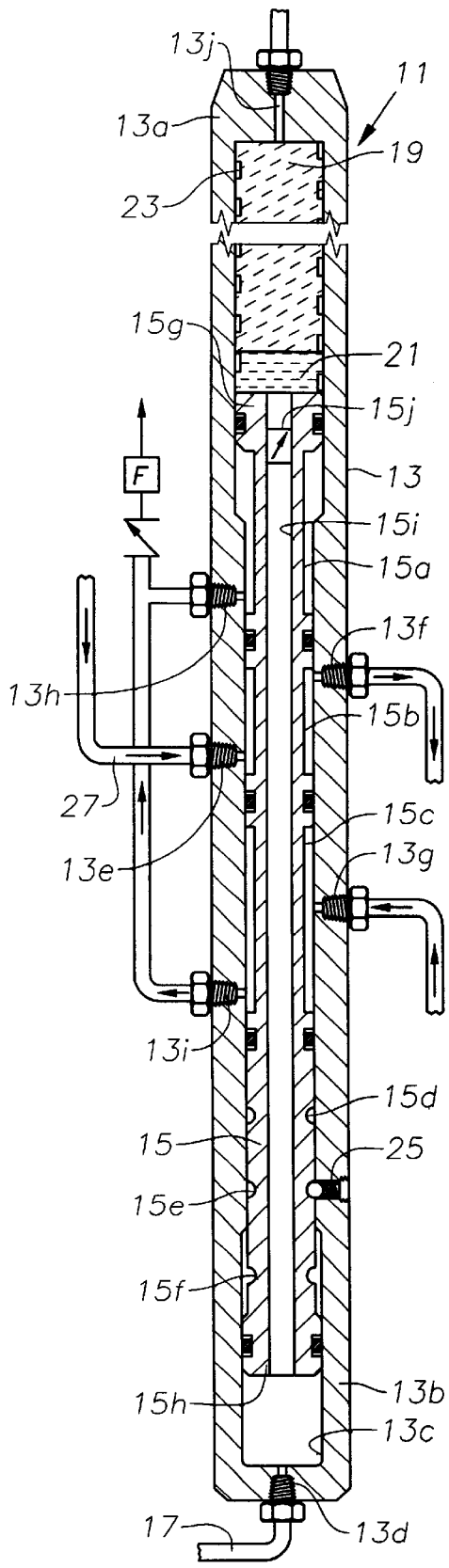
FIG. 9 is a side elevation view of the downhole valve shown in FIG. 8, and illustrates the valve in a second position.
Figure 10:
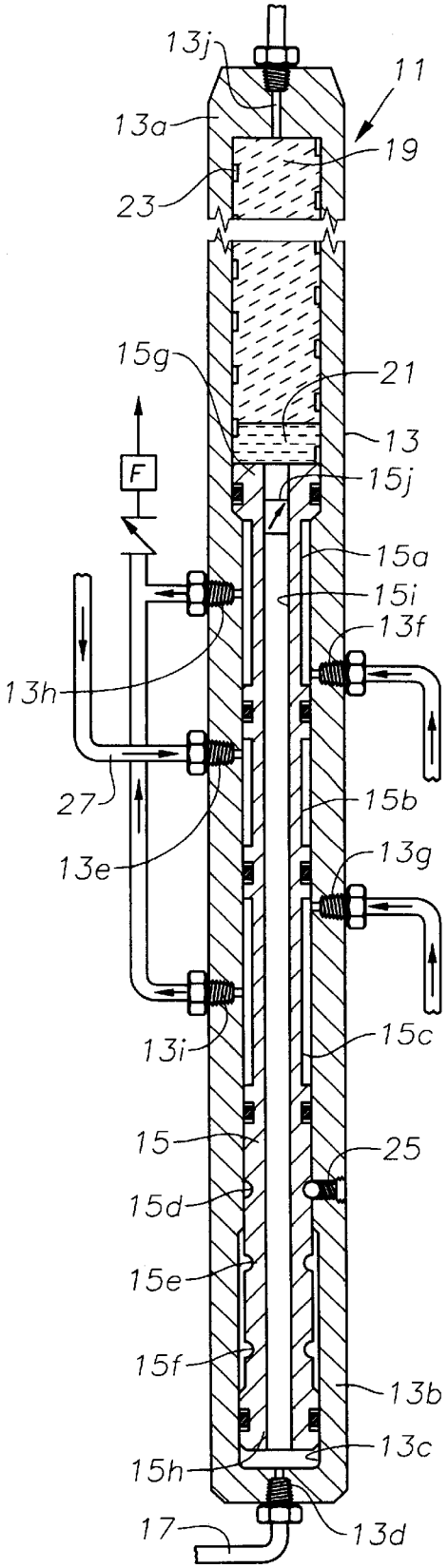
FIG. 10 is a side elevation view of the downhole valve shown in FIGS. 8 and 9, and illustrates the valve in a third position.

The position holder 16 may be provided in a variety of configurations. In a specific embodiment, as shown in FIGS. 5–7, more fully discussed below, the position holder 16 may be a cammed indexer that cooperates with the retaining member 34, such as a "J"-hook (see, e.g., "J"-hook 136 in FIG. 14B) or a spring-loaded pin, to hold the indexer in a plurality of discrete positions. In this embodiment, the cammed indexer 16 is movably disposed within the valve body 12, is connected to the piston 14, and is engaged with the retaining member 34, as will be more fully described below. In another specific embodiment, as shown in FIGS. 8–10, more fully discussed below, the position holder 16 may be provided with a plurality of notches, or annular grooves, for mating with the retaining member 34, which may be a spring-loaded detent ball or a collet finger; alternatively, the spring-loaded detent ball or collet finger may be attached to the position holder 16 and the notches or annular recesses may be disposed about an inner surface of the valve body 12. The position holder 16 shown in FIG. 1 has four positions. However, the present invention is not intended to be limited to a position holder having any particular number of positions, but, instead, is intended to encompass position holders having any number of positions. As will be more fully discussed below, the number of position-holder positions may correspond to the number of outlet ports 26–32.

Figure 2:
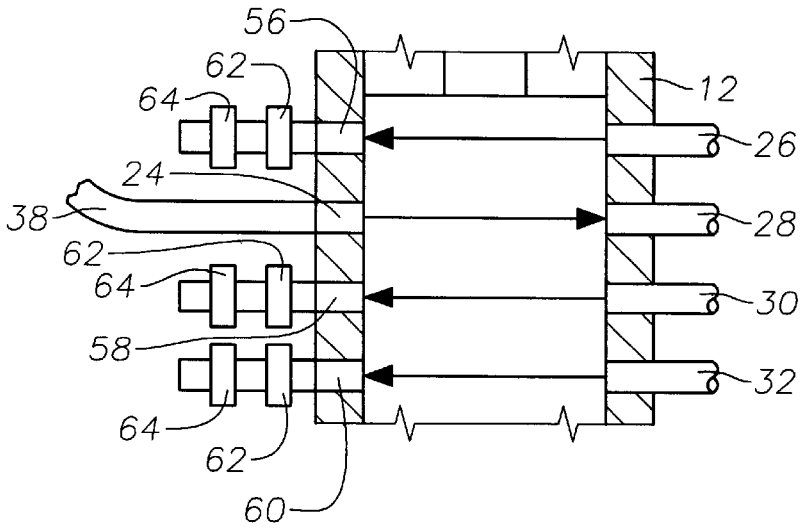
FIG. 2 is a partial schematic representation of a portion of the downhole valve shown in FIG. 1, and illustrates the valve in a second position.
Figure 3:
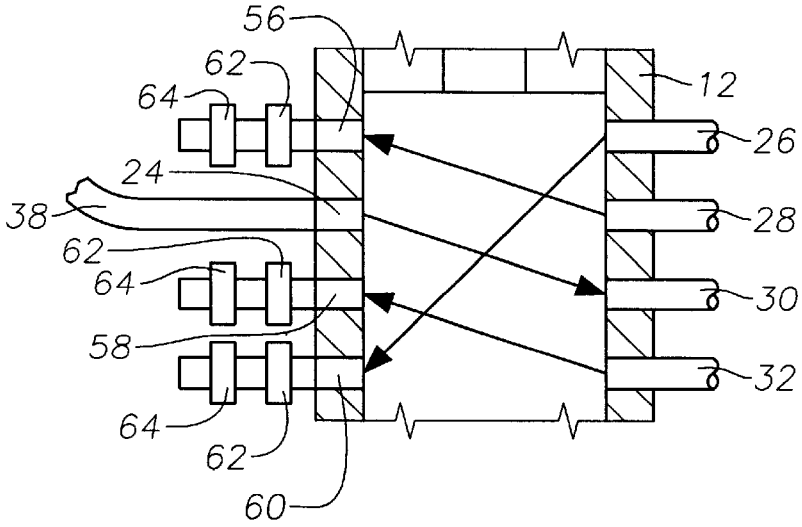
FIG. 3 is a partial schematic representation of a portion of the downhole valve shown in FIG. 1, and illustrates the valve in a third position.

The fluid transfer member 18 is movably disposed within the valve body 12 and includes a plurality of fluid channels therethrough, as indicated by dashed lines 42–48. The fluid transfer member 18 is connected to the piston 14 and the position holder 16. In a specific embodiment, the fluid transfer member 18 may be a shuttle valve, of the type well known to those of ordinary skill in the art. As will be more fully explained below, the position holder 16 and the retaining member 34 cooperate to maintain the fluid transfer member 18 in a plurality of discrete positions. One of the plurality of fluid channels 42–48 in the fluid transfer member 18 establishes fluid communication between the second fluid supply line 38 and one of the plurality of fluid outlet ports 26–32 for at least one of the plurality of discrete fluid-transfer-member positions. In this embodiment, when the position holder 16 is in a first position, as shown in FIG. 1, one of the fluid channels 42–48 establishes fluid communication between the second fluid supply line 38 and the first fluid outlet port 26. When the position holder 16 is in a second position, as shown in FIG. 2, one of the fluid channels 42–48 establishes fluid communication between the second fluid supply line 38 and the second fluid outlet port 28. When the position holder 16 is in a third position, as shown in FIG. 3, one of the fluid channels 42–48 establishes fluid communication between the second fluid supply line 38 and the third fluid outlet port 30. Finally, when the position holder 16 is in a fourth position, as shown in FIG. 4, one of the fluid channels 42–48 establishes fluid communication between the second fluid supply line 38 and the fourth fluid outlet port 32.

Figure 4:
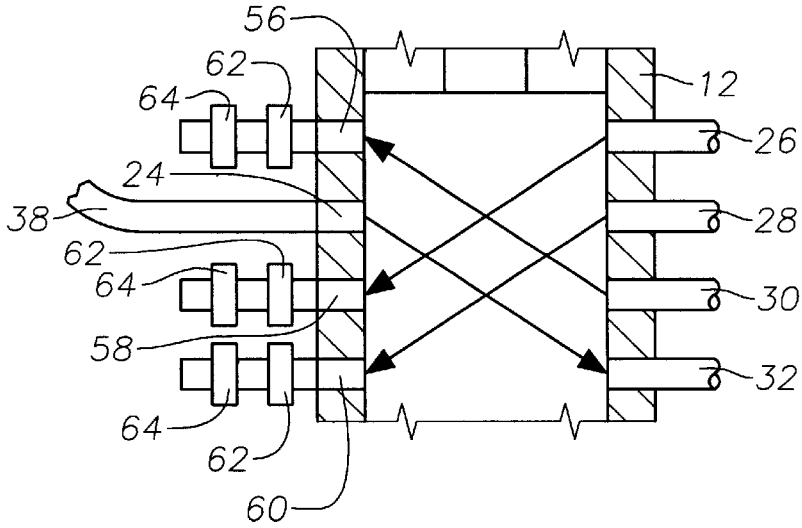
FIG. 4 is a partial schematic representation of a portion of the downhole valve shown in FIG. 1, and illustrates the valve in a fourth position.

In a specific embodiment, the valve body 12 may further include a plurality of fluid exhaust ports 56–60, at least one of which is in fluid communication through one of the fluid channels 42–48 with one of the fluid outlet ports 26–32, other than the fluid outlet port 26–32 in fluid communication with the second fluid supply line 38, for at least one of the plurality of discrete fluid-transfer-member positions shown in FIGS. 1–4. In a specific embodiment, the fluid exhaust ports 56–60 may each be provided with a one-way check valve or a pressure relief valve 62 to assure flow of hydraulic fluid in one direction only. In a specific embodiment, the fluid exhaust ports 56–60 may each be provided with a filter 64 to prevent wellbore debris from entering the system. However, inclusion of check valves or pressure relief valves 62 or filters 64 should not be taken as a limitation. In one specific embodiment, it may be operationally desirable to block or plug an exhaust discharge port 56–60, or direct the discharged hydraulic fluid elsewhere, and still be within the scope and spirit of the invention. In another specific embodiment, each of the plurality of fluid exhaust ports is in fluid communication through one of the plurality of fluid channels 42–48 with one of the fluid outlet ports 26–32, other than the fluid outlet port that is in fluid communication with the second fluid supply line 38, for each of the plurality of discrete fluid-transfer-member positions. For example, when the position holder 16 is in a first position, as shown in FIG. 1, fluid communication is established: (1) between the second fluid supply line 38 and the first fluid outlet port 26 through one of the fluid channels 42–48, (2) between the second fluid outlet port 28 and the second fluid exhaust port 58 through one of the fluid channels 42–48; (3) between the third fluid outlet port 30 and the third fluid exhaust port 60 through one of the fluid channels 42–48; and (4) between the fourth fluid outlet port 32 and the first fluid exhaust port 56 through one of the fluid channels 42–48. When the position holder 16 is in a second position, as shown in FIG. 2, fluid communication is established: (1) between the second fluid supply line 38 and the second fluid outlet port 28; (2) between the first fluid outlet port 26 and the first fluid exhaust port 56; (3) between the third fluid outlet port 30 and the second fluid exhaust port 58; and (4) between the fourth fluid outlet port 32 and the third fluid exhaust port 60. When the position holder 16 is in a third position, as shown in FIG. 3, fluid communication is established: (1) between the second fluid supply line 38 and the third fluid outlet port 30; (2) between the first fluid outlet port 26 and the third fluid exhaust port 60; (3) between the second fluid outlet port 28 and the first fluid exhaust port 56; and (4) between the fourth fluid outlet port 32 and the second fluid exhaust port 58. Finally, when the position holder 16 is in a fourth position, as shown in FIG. 4, fluid communication is established: (1) between the second fluid supply line 38 and the fourth fluid outlet port 32; (2) between the first fluid outlet port 26 and the second fluid exhaust port 58; (3) between the second fluid outlet port 28 and the third fluid exhaust port 60; and (4) between the third fluid outlet port 30 and the first fluid exhaust port 56.

In a specific embodiment, the valve 10 may further include a return means for biasing the piston 14 toward the first end 22 of the valve body 12. It should be understood that the present invention is not intended to be limited to any particular return means, but, instead, is intended to encompass any return means within the knowledge of those of ordinary skill in the art. For example, in a specific embodiment, the return means may be a spring 50. In another specific embodiment, the return means may be a gas chamber 52. For example, the gas chamber 52 may be charged with pressurized nitrogen. Alternatively, the return means may include both the spring 50 and the gas chamber 52. In yet another specific embodiment, the return means may be a balance line 54 that is connected to the second fluid supply line 38, or to a third source of pressurized fluid, such as at the earth's surface (not shown). In those cases where the balance line 54 is connected to the second fluid supply line 38, the pressure in the balance line 54 may be controlled in any manner known to those of skill in the art, such as, for example, by including in the balance line 54 a pressure relief valve, or a choke and accumulator, such as those shown in FIG. 21. Again, the present invention is not intended to be limited to any particular return means.

In another specific embodiment, the valve 10 may include at least one proximity sensor 66 to provide a signal via a conductor 68 to a control panel (not shown) to indicate the position of the fluid transfer member 18. In this manner, an operator at the earth's surface will be informed as to which of the outlet ports 26–32 is being supplied with pressurized fluid, which will inform the operator which of the downhole tools (not shown) is being actuated. It should be understood that the present invention is not intended to be limited to any particular type of proximity sensor, but, instead, is intended to encompass any type of proximity sensor within the knowledge of those of ordinary skill in the art. For purposes of illustration only, in a specific embodiment, the proximity sensors 66 may be fiber optic sensors 66 connected to the valve body 12 and to fiber optic conductor cables 68, and may sense corresponding contacts 70 connected to the fluid transfer member 18. In another specific embodiment, the proximity sensors 66 may be magnetic sensors 66 connected to the valve body 12 and to low-voltage electrical insulated cables 68, and may sense corresponding contacts 70 connected to the fluid transfer member 18. As an alternative to using sensors on the valve 10 to indicate which of the outlet ports 26–32 are being supplied with pressurized fluid, a synchronizer (not shown) may be provided at the earth's surface to provide an indication of the position of the fluid transfer member 18 based upon the number of hydraulic pulses that have been sent to the valve 10, in a manner well known to those of skill in the art. As yet another alternative, the position of the fluid transfer member 18 may be determined simply by reading the hydraulic pressure, at the earth's surface, that is being supplied to the valve 10.

As mentioned above, one sample specific embodiment of the position holder 16 may be a cammed indexer, which will now be described in detail with reference to FIGS. 5–7. As best shown in FIG. 7, the indexer 16 preferably includes a plurality of axial slots 72 of varying length disposed circumferentially around the indexer 16, each of which are adapted to selectively receive a portion of the retaining member 34 (see FIG. 1) provided at a fixed location on the valve body 12. In a specific embodiment, the retaining member 34 may be a spring-loaded detent pin or a "J"-hook. Because the indexer 16 is normally biased toward the first end 22 of the valve body 12 by the return means, the retaining member 34 will normally be engaged within an upper portion 74 of one of the axial slots 72. As such, the indexer 16 and retaining member 34 thereby cooperate to maintain the fluid transfer member 18 in a plurality of discrete position, the particular discrete position depending on which axial slot 72 the retaining member is located in. The particular axial slot 72 in which the retaining member 34 is disposed can be remotely selected by the operator, as described further below. Therefore, by selecting an axial slot 72 having a desired length, the operator can remotely select the desired position of the fluid transfer member 18 axially within the valve body 12, which will determine which fluid outlet port 26–32 is in fluid communication with the second fluid supply line 38, which will thereby determine which downhole tool (not shown) is actuated.

A particular axial slot 72 having a desired length may be remotely selected by an operator by momentarily providing hydraulic pressure, for example, in the form of a pressure oscillation, through the first fluid supply line 36, which will cause movement of the piston 14 away from the first end 22 of the valve body 12. As previously described, movement of the piston 14 will cause the indexer 16 to also move away from the first end 22 of the valve body 12 axially within the valve body 12 relative to the retaining member 34. A lower portion 76 of each of the axial slots 72 has a smaller diameter than the upper portion 74 of each of the axial slot 72 and is, thereby, recessed from the upper portion 74 thereof, as best illustrated in FIG. 5. Therefore, as the indexer 16 is moved away from the first end 22 of the valve body 12 with respect to the retaining member 34, the retaining member 34 will travel in the axial slot 72 toward the first end 22 of the valve body 12 and into the recessed lower portion 76 of the axial slot 72. As soon as the retaining member 34 has dropped into the recessed lower portion 76, hydraulic pressure should then be removed from the first fluid supply line 36, at which time the return means will shift the indexer 16 toward the first end 22 of the valve body 12. Since the retaining member 34 is biased within the axial slot 72, the retaining member 34 is prevented from returning directly to the upper portion 74 of axial slot 72, and, instead, is directed against an angled surface 78 of the axial slot 72 separating the recessed lower portion 76 of the axial slot 72 from the elevated upper portion 74 of the axial slot 72. The bearing force of the retaining member 34 against the angled surface 78 on motion of the indexer 16 with respect to the retaining member 34 is then translated into rotatable motion of the indexer 16 with respect to the retaining member 34, which then continues to be engaged within a tapered intermediate slot 80 of the indexer 16, which guides the retaining member 34 into the immediately neighboring axial slot 72 having a different length. The return means continues to move the indexer 16 toward the first end 22 of the valve body 12 until the retaining member 34 comes to rest against the upper portion 74 of the immediately neighboring axial slot 72. In this manner, the indexer 16 causes the fluid transfer member 18 to be rotated and/or longitudinally shifted into a discrete position. In this regard, the fluid transfer member 18 will be both rotated and longitudinally shifted if the fluid transfer member 18 is fixedly attached to the indexer 16, whereas the fluid transfer member 18 will only be longitudinally shifted if the fluid transfer member 18 is rotatably attached to the indexer 16, as by a bearing. The number of discrete positions attainable is dependent upon the number of axial slots 72. As explained above, the present invention is not limited to any particular number of discrete positions. The indexer 16 can be selectively and successively indexed between each of the axial slots 72 to selectively choose the desired axial slot length and, accordingly, the desired position of the fluid transfer member 18, to control which fluid outlet port 26–32 is in communication with the second fluid supply line 38.

From the foregoing, it can be seen that the valve 10 of the present invention enables the downhole control and operation of any number of downhole hydraulically-actuated well tools with the use of only two hydraulic control lines running from the earth's surface to the valve 10, those two control lines being first and second fluid supply lines 36 and 38. The first fluid supply line 36 is used to apply hydraulic pressure oscillations to the piston 14, which in turn causes the indexer 16 to shift the fluid transfer member 18 into various discrete positions. A pressure increase on the first fluid supply line 36 allows a diversion of pressure supplied from a surface mounted pump (not shown) through the second fluid supply line 38 to one of a plurality of fluid outlet ports 26–32. Further pressure oscillations applied through the first fluid supply line 36 causes a cycling of pressurized hydraulic fluid from the second fluid supply line 38 to the next respective outlet port 26–32, in turn, until all outlet ports 26–32 have delivered hydraulic fluid.

Another specific embodiment of the valve of the present invention is shown in FIGS. 8–10, and is designated generally as valve 11. The valve 11 may include a valve body 13 having a first end 13*a*, a second end 13*b*, an enclosed inner bore 13*c*, a first fluid inlet port 13*d*, a second fluid inlet port 13*e*, a first fluid outlet port 13*f*, a second fluid outlet port 13*g*, a first fluid exhaust port 13*h*, and a second fluid exhaust port 13*i*. A shiftable valve member 15 is disposed for longitudinal movement within the inner bore 13*c*. The valve member 15 may include a first annular recess 15*a*, a second annular recess 15*b*, a third annular recess 15*c*, a first notch or annular groove 15*d*, a second notch or annular groove 15*e*, a third notch or annular groove 15*f*, a first end 15*g*, and a second end 15*h*. A first fluid supply line 17 is connected to a source of pressurized fluid and to the first fluid inlet port 13*d* on the valve body 13. As more fully explained below, pressure may be applied to the second end 15*h* of the valve member 15 to shift the valve member 15 within the valve body 13. A return means is provided within the first end 13*a* of the valve body 13 adjacent the first end 15*g* of the valve member 15 to bias the valve member 15 to a normally closed, or fail safe, position, as shown in FIG. 10. As further explained below, this "fail-safe" feature is particularly advantageous when the valve 11 is being used to control one of more subsurface safety valves (SCSSV). In a specific embodiment, the return means may be pressurized gas 19, such as pressurized nitrogen. In this embodiment, the valve body 13 may include a charging port 13*j* (e.g., a dill core valve) through which the pressurized gas may be placed within the valve body 13 prior to lowering the valve 11 into a well. In this embodiment, the return means may further include a viscous fluid 21, such as silicone, between the pressurized gas 19 and the first end 15*g* of the valve member 15. In another embodiment, the return means may comprise a spring 23. In another embodiment, the return means may include both the pressurized gas 19 and the spring 23. In yet another embodiment, the return means may include a balance line connected to the port 13*j* in the same manner as described above in connection with FIG. 1 (see balance line 54).

A retaining member 25 is mounted to the valve body 13 to cooperate with the notches/grooves 15*d–f* to maintain the valve member 15 in a plurality of discrete positions. This embodiment illustrates a three-position valve member 15, but the invention should not be limited to any particular number of positions. In a specific embodiment, the retaining member 25 may be a spring-loaded detent ball. In another specific embodiment, the retaining member 25 may be a collet finger. In another specific embodiment, the positions of the retaining member 25 and the grooves/notches 15*d–f* could be switched. That is, the retaining member 25 could be attached to the valve member 15 instead of the valve body 13, and the notches/grooves 15*d–f* could be disposed within the bore 13*c* instead of on the valve member 15. A second fluid supply line 27 is connected to a source of pressurized fluid and to the second fluid inlet port 13*e* on the valve body 13. The valve 11 is designed to enable an operator at the earth's surface to remotely allow or prohibit the flow of pressurized fluid from the second fluid supply line 27 through the valve 11. Further, where it is desired to allow the flow of pressurized fluid through the valve 11, the valve 11 is designed so as to permit the operator to select which of the outlet ports 13*f* or 13*g* the pressurized fluid is directed to, thereby allowing the operator to remotely actuate and deactuate downhole tools that are connected to the outlet ports 13*f* and 13*g*, as will be more fully explained below.

The specific embodiment of the valve 11 shown in FIGS. 8–10 is provided with three positions: a first position (FIG. 8); a second position (FIG. 9); and a third position (FIG. 10), also referred to as the "normally-closed" or "fail-safe" position. In the first position, as shown in FIG. 8, the third annular recess 15*c* is situated so as to route fluid from the second fluid supply line 27 to the second fluid outlet port 13*g*, and the second annular recess 15*b* is situated so as to exhaust fluid from a downhole tool (not shown) to the first exhaust port 13*h*. The exhausted fluid may be passed through a one-way check valve or pressure relief valve 29 and/or a filter 31 before being vented to the annulus or routed back to the surface. In the second position, as shown in FIG. 9, the second annular recess 15*b* is situated so as to route fluid from the second fluid supply line 27 to the first fluid outlet port 13*f*, and the third annular recess 15*c* is situated so as to exhaust fluid from a downhole tool (not shown) to the second exhaust port 13*i*. The exhausted fluid may be passed through the check valve or pressure relief valve 29 and/or filter 31 before being vented to the annulus. As eluded to above, in the event the first fluid supply line 17 were to rupture, the return means (19/21/23) would automatically shift the valve 11 to its "normally-closed" or "fail-safe" position, as shown in FIG. 10. In this position, no pressurized fluid would be permitted to pass through the valve 11 to any downhole tool connected to the first or second outlet ports 13*f* or 13*g*. Instead, the first annular recess 15*a* would be aligned so as to vent pressure from a downhole tool (not shown) through the first outlet port 13*f* and through the first exhaust port 13*h*. Likewise, the third annular recess 15*c* would be aligned so as to vent pressure from another downhole tool (not shown) through the second outlet port 13*g* and through the second exhaust port 13*i*.

The shiftable valve member 15 may be further provided with a longitudinal bore 15*i* therethrough and a pressure equalizing valve 15*j* disposed in the longitudinal bore 15*i*. The purpose of providing the longitudinal bore 15*i* and pressure equalizing valve 15*j* is to equalize the pressure on both sides of the valve member 15 in the event that a seal containing the pressurized gas 19 breaks, thereby allowing the pressurized gas 19 to escape, such as to the well annulus. When the pressure is equalized across the valve member 15, the spring 23 will force the valve member 15 into its third or "fail-safe" position, as shown in FIG. 10. The structure and operation of the pressure equalizing valve 15*j* may be as disclosed in U.S. Pat. No. 4,660,646 (Blizzard) or U.S. Pat. No. 4,976,317 (Leismer), each of which is commonly assigned hereto and incorporated herein by reference.

The manner in which the valve member 15 is moved back and forth between its various positions will now be explained. For example, to move the valve member 15 from its third position (FIG. 10) to its second position (FIG. 9), a predetermined magnitude of pressurized fluid is applied from the first fluid supply line 17 to the second end 15*h* of the valve member 15 to overcome the return means and shift the valve member 15 so that the detent ball 25 disengages from the first notch/groove 15*d* and engages with the second notch/groove 15*e*. Similarly, to move the valve member 15 from its second position (FIG. 9) to its first position (FIG. 8), a predetermined magnitude of pressurized fluid is applied from the first fluid supply line 17 to the second end 15*h* of the valve member 15 to shift the valve member 15 so that the detent ball 25 disengages from the second notch/groove 15*e* and engages with the third notch/groove 15*f*. In a similar manner, the valve member 15 may be shifted back to its second and third positions by bleeding off a sufficient amount of pressurized fluid from the first fluid supply line 17 to allow the return means (19/21/23) to shift the valve member 15 into its second and third positions. As explained elsewhere herein, the valve 11 may further be provided with appropriate sensors and conductor cables to transmit a signal to the earth's surface corresponding to the various positions of the valve member 15. As also explained below in relation to FIGS. 21 and 22, a plurality of valves 11 may be incorporated into a fluid control system, in series and/or parallel combinations, to permit the remote control of numerous downhole well tools via one or two hydraulic control lines running from the earth's surface. The valve member 15 is further provided with appropriate seals for reasons that will be readily apparent to those of ordinary skill in the art.

The valves 10 and 11 of the present invention, as described above, can be used in a variety of configurations. For example, the valves 10 and 11 can be provided as a stand-alone tool as shown in FIGS. 1–4 and 8–10. The valves 10 and 11 may be tubing-deployed or wireline-retrievable. In another embodiment, the valves 10 and 11 may be incorporated into another downhole well tool. For example, the valves 10 and 11 may be incorporated into a wireline-retrievable side-pocket mandrel. Alternatively, the valves 10 and 11 may be incorporated into a sidewall of a subsurface safety valve.

Figure 11:
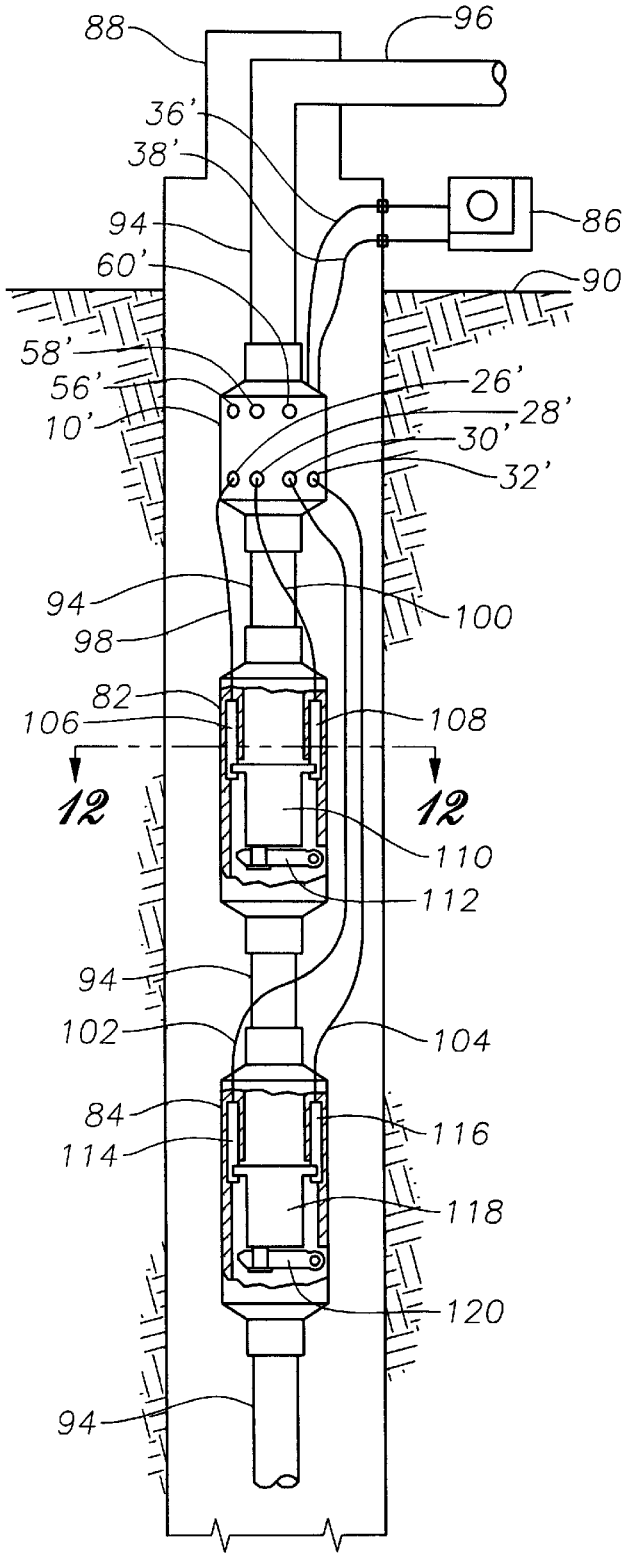
FIG. 11 is a partial schematic representation of an "intelligent well completion," utilizing a tubing-deployed downhole valve of the type shown in FIGS. 1–4 or 8–10, which is shown controlling tandem surface-controlled subsurface safety valves, in a typical configuration for subsea wells.
Figure 23:
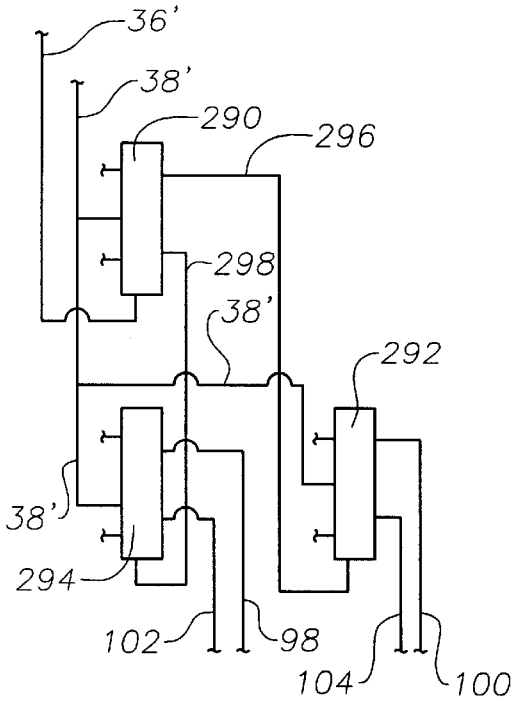
FIG. 23 is a schematic representation of an arrangement of the downhole valves of the present invention for use in controlling two subsurface safety valves, as shown in FIGS. 11 and 13.

Referring now to FIG. 11, a partial schematic representation of an "intelligent well completion" is shown utilizing a tubing-deployed downhole valve 10' of the present invention to control a first and a second surface-controlled subsurface safety valve (SCSSV) 82 and 84, in a typical configuration for subsea wells. One of ordinary skill in the art will immediately recognize that each of the SCSSVs 82 and 84 includes dual and redundant hydraulic pistons, but this should not be taken as a limitation. A first fluid supply line 36' and a second fluid supply line 38' supply pressurized hydraulic fluid from a source of pressurized fluid, such as a pump (not shown), in a surface control panel 86 to the valve 10'. Other items of interest in the completion are a wellhead 88, residing on the sea floor 90, a well casing 92, and a production tubing string 94 that directs hydrocarbons into a subsea flow line 96. The SCSSVs 82 and 84 may be any type of surface-controlled subsurface safety valve known to those of ordinary skill in the art, examples of which include those disclosed in U.S. Pat. No. 4,161,219 (Pringle), U.S. Pat. No. 4,660,646 (Blizzard), U.S. Pat. No. 4,976,317 (Leismer), and U.S. Pat. No. 5,503,229 (Hill, Jr. et al.), each of which is commonly assigned hereto and incorporated herein by reference. The first safety valve 82 may include a second piston 106, a third piston 108, a first flow tube 110, and a first valve closure member 112. The first flow tube 110 is movable in response to movement of at least one of the second and third pistons 106 and 108 to open and close the first valve closure member 112. The second safety valve 84 may include a fourth piston 114, a fifth piston 116, a second flow tube 118, and a second valve closure member 120. The second flow tube 118 is movable in response to movement of at least one of the fourth and fifth pistons 114 and 116 to open and close the second valve closure member 120.

The completion shown in FIG. 11 may be provided with one or more of the valves of the present invention. The specific embodiment shown in FIG. 11 is shown with a single valve 10', more fully discussed below. In another specific embodiment, the single valve 10' may be replaced with three valves 290, 292, and 294 as shown schematically in FIG. 23. This latter specific embodiment provides an operator at the earth's surface with the ability to satisfy each of the following four conditions: (1) hold both of the SCSSVs 82 and 84 open at the same time; (2) hold both of the SCSSVs 82 and 84 closed at the same time; (3) hold SCSSV 82 open while at the same time holding SCSSV 84 closed; and (4) hold SCSSV 82 closed while at the same time holding SCSSV 84 open. In this embodiment, with reference to FIG. 23, the valves 290,292, and 294 may be of the type illustrated in FIGS. 8–10. With reference to FIGS. 8–11 and 23, a first fluid supply line 36' is connected to the first valve 290 to provide pressurized fluid thereto to bias the shiftable valve member 15 (FIGS. 8–10) against the return means 19/21/23 (FIGS. 8–10), and a second fluid supply line 38' is connected to each of the valves 290, 292, and 294 to provide pressurized fluid for distribution therethrough. One of the outlet ports of the first valve 290 is connected via a conduit 296 to the second valve 292 to move the second valve 292 between its various positions, and the other of the outlet ports of the first valve 290 is connected via a conduit 298 to the third valve 294 to move the third valve 294 between its various positions. The outlet ports of the second valve 292 are connected to the first and second SCSSV 82 and 84 (see FIG. 11) via the conduits 100 and 104, respectively. The outlet ports of the third valve 294 are connected to the first and second SCSSV 82 and 84 (see FIG. 11) via the conduits 98 and 102, respectively. Using this specific embodiment, an operator at the earth's surface can remotely control the opening and closing of the two SCSSVs 82 and 84 and satisfy each of the four above-listed conditions by controllably modifying the pressure of the fluid being applied through the first fluid control line 36' to the first valve 290. More specifically, the first valve 290 is used to control the second and third valves 292 and 294. By changing the pressure of the fluid being applied through the first fluid supply line 36' to the first valve 290, the operator is able to remotely select which of the conduits 98–104 are supplied with pressurized fluid and/or whether fluid is exhausted from one or more of the valves 290–294. It is noted, as explained in more detail elsewhere herein, that the valves 290–294 are designed such that fluid will be exhausted from the SCSSVs 82 and 84 in the event of any failure or loss of control of the valves 290–294 due to a rupture in the first fluid supply line 36'. In another embodiment, in the event that each of the tandem SCSSVs 82 and 84 is provided with a single operating piston, as opposed to dual pistons as shown in FIG. 11, the single valve 10' shown in FIG. 11 may be replaced with two valves of the present invention, in an arrangement similar to that shown in FIG. 23. This embodiment will also provide the operator at the earth's surface with the ability to satisfy each of the four above-listed conditions.

As mentioned above, in a specific embodiment, the completion shown in FIG. 11 may also be provided a single valve 10'. In this specific embodiment, the downhole valve 10' may include a plurality of outlet ports 26'–32', each connected to a plurality of conduits 98–104, two are directed to the first SCSSV 82, and two are directed to the SCSSV 84. It will be immediately obvious to one skilled in the art that a greater or lesser number of output ports may be used to match the number of hydraulically operated tools/ports employed in the completion. Further, it will be obvious from the disclosure of this invention that other types of equipment may be conceived and adapted to receive this manner of hydraulic control. In a specific embodiment, the downhole valve 10' may include a first outlet port 26', a second outlet port 28', a third outlet port 30', and a fourth outlet port 32'. The second piston 106 on the first SCSSV 82 is in fluid communication with the first outlet port 26' on the downhole valve 10' through the first conduit 98, and the third piston 108 is in fluid communication with the second outlet port 28' on the downhole valve 10' through the second conduit 100. The fourth piston 114 on the second SCSSV 84 is in fluid communication with the third outlet port 30' on the downhole valve 10' through the third conduit 102, and the fifth piston 116 is in fluid communication with the fourth outlet port 32' on the downhole valve 10' through the fourth conduit 104.

In a specific embodiment, the downhole valve 10' may further include a plurality of fluid exhaust ports 56'–60', at least one of which is in fluid communication with one of the fluid outlet ports 26'–32', other than the fluid outlet port in fluid communication with the second fluid supply line 38, for at least one of the plurality of discrete fluid-transfer-member positions. In operation, pressure oscillations on the first fluid supply line 36 redirect the pressurized hydraulic fluid conveyed through the second fluid supply line 38 and into one of the outlet ports 26'–32', and subsequently into one of the conduits 98–104, for transport to a selected use point, in this case one or the other SCSSV 82 or 84, while subsequently venting the other three lines, such as through the exhaust ports 56'–60'. As noted above, when the downhole tool being controlled through use of the valve of the present invention is a SCSSV, as is the case with FIG. 11, it is important that the valve 10' be designed to fail in a closed position. More specifically, if there is a rupture in the first fluid supply line 36', the valve 10' should return to a default or normally closed position so that pressurized fluid is restricted from flowing from the second fluid supply line 38' to either of the SCSSVs 82 or 84 and all pressurized fluid is exhausted from the SCSSVs 82 and 84 through the exhaust ports 56'–60' to enable the SCSSVs 82 and 84 to move to their respective "fail-safe" or "normally-closed" positions.

Figure 12:
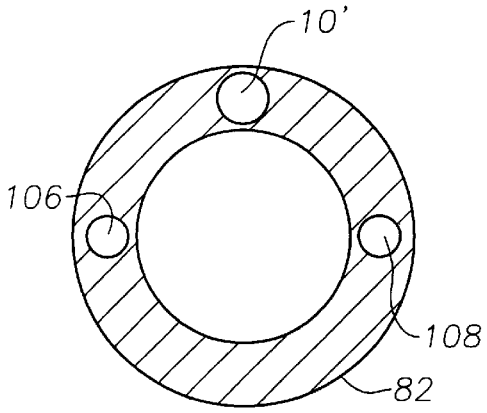
FIG. 12 is a cross-sectional view taken along line 12—12 of FIG. 11 and illustrates the downhole valve of the present invention located within a sidewall of a subsurface safety valve.

In another specific embodiment, as shown in FIG. 12, which is a cross-sectional view taken along line 12—12 of FIG. 11, the downhole valve 10' may be located in the wall of an SCSSV 82, or any other suitable downhole device that has a wall of sufficient thickness to accommodate the dimensions of the valve 10', or it may be secured to the outside diameter of a downhole device, such as a nipple or pup joint (neither shown).

Figure 13:
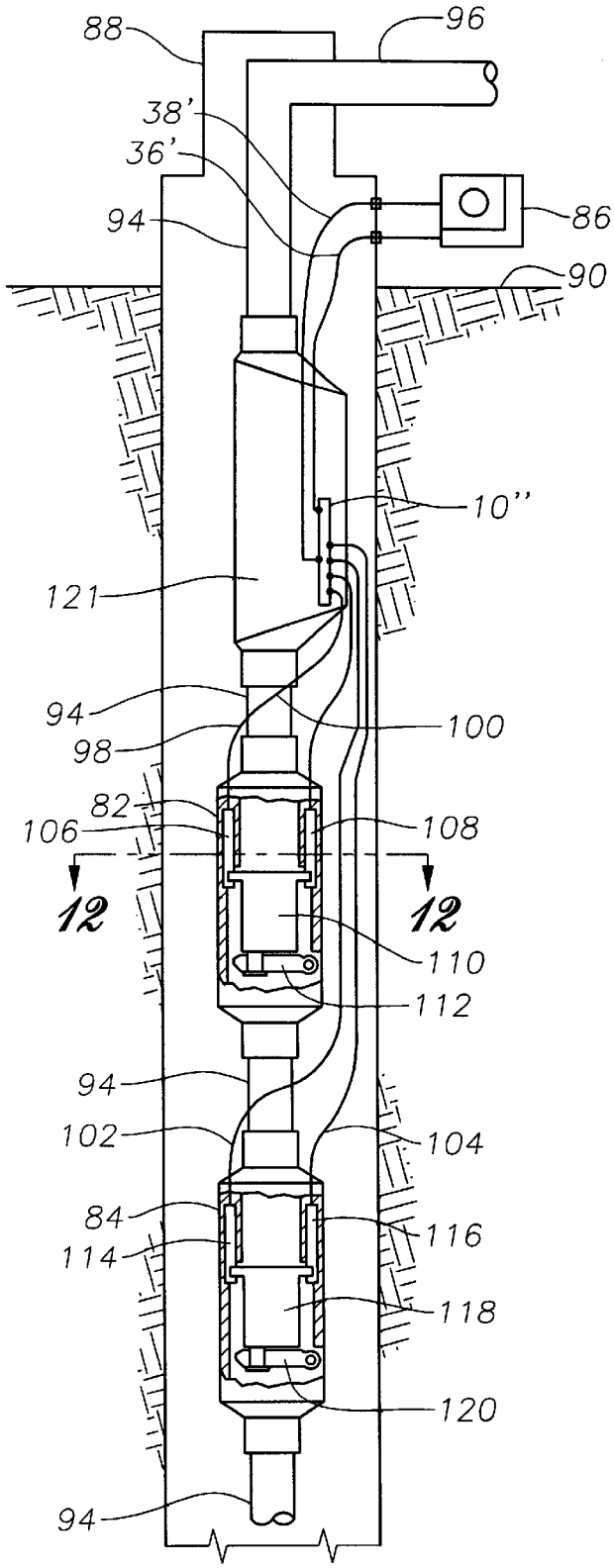
FIG. 13 is a partial schematic representation of an "intelligent well completion," utilizing a side-pocket-mandrel-deployed downhole valve of the type shown in FIGS. 1–4 or 8–10, which is shown controlling tandem surface-controlled subsurface safety valves, in a typical configuration for subsea wells.

Referring now to FIG. 13, which is a partial schematic representation of another "intelligent well completion," a downhole valve 10" is shown deployed within a side pocket mandrel 121. As will be readily apparent to one of ordinary skill in the art, the valve 10" may be "wireline retrievable," and may be provided with a latching mechanism, such as the latching mechanism 174 shown in FIG. 19C, discussed below, for mating with a wireline tool (not shown) to enable an operator at the earth's surface to remotely retrieve and/or install the valve 172, in a manner well known to those of ordinary skill in the art. The downhole valve 10" is again shown controlling tandem surface controlled subsurface safety valves 82 and 84, in a typical configuration for subsea wells. As before, a first fluid supply line 36' and a second fluid supply line 38' supply pressurized hydraulic fluid from a pump (not shown) in a surface control panel 86 to the valve 10". Also as before, the valve 10" may include three valves, such as the valves 290–294 shown in FIG. 23. All other aspects of FIG. 13 are the same as explained above in connection with FIGS. 11, 12, and 23.

Figure 14A:
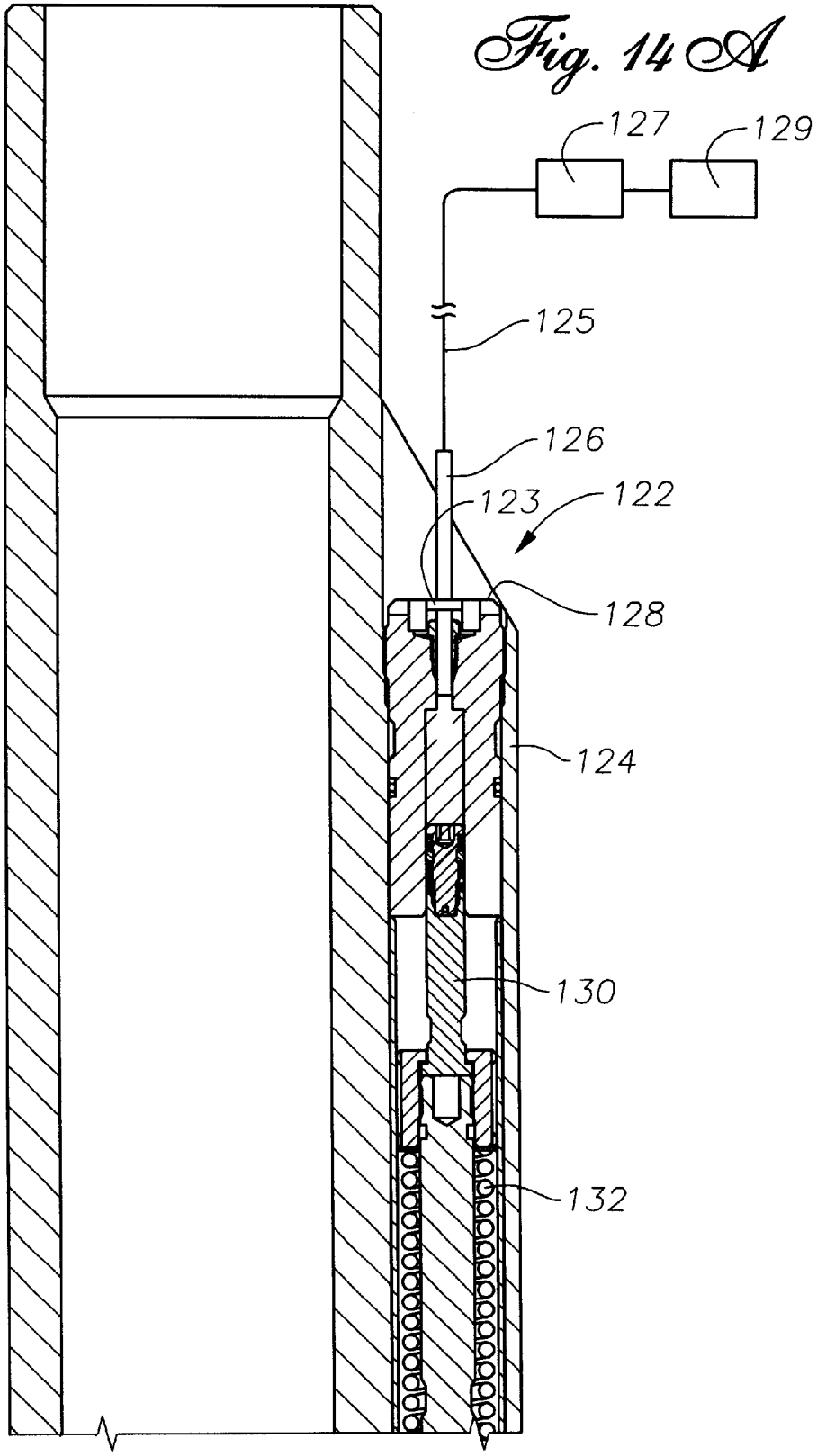
FIGS. 14A and 14B are elevation views which together show a tubing-deployed downhole valve of the present invention, with a single hydraulic oscillation line, a single hydraulic pressure input line and five hydraulic pressure output lines.
Figure 14B:
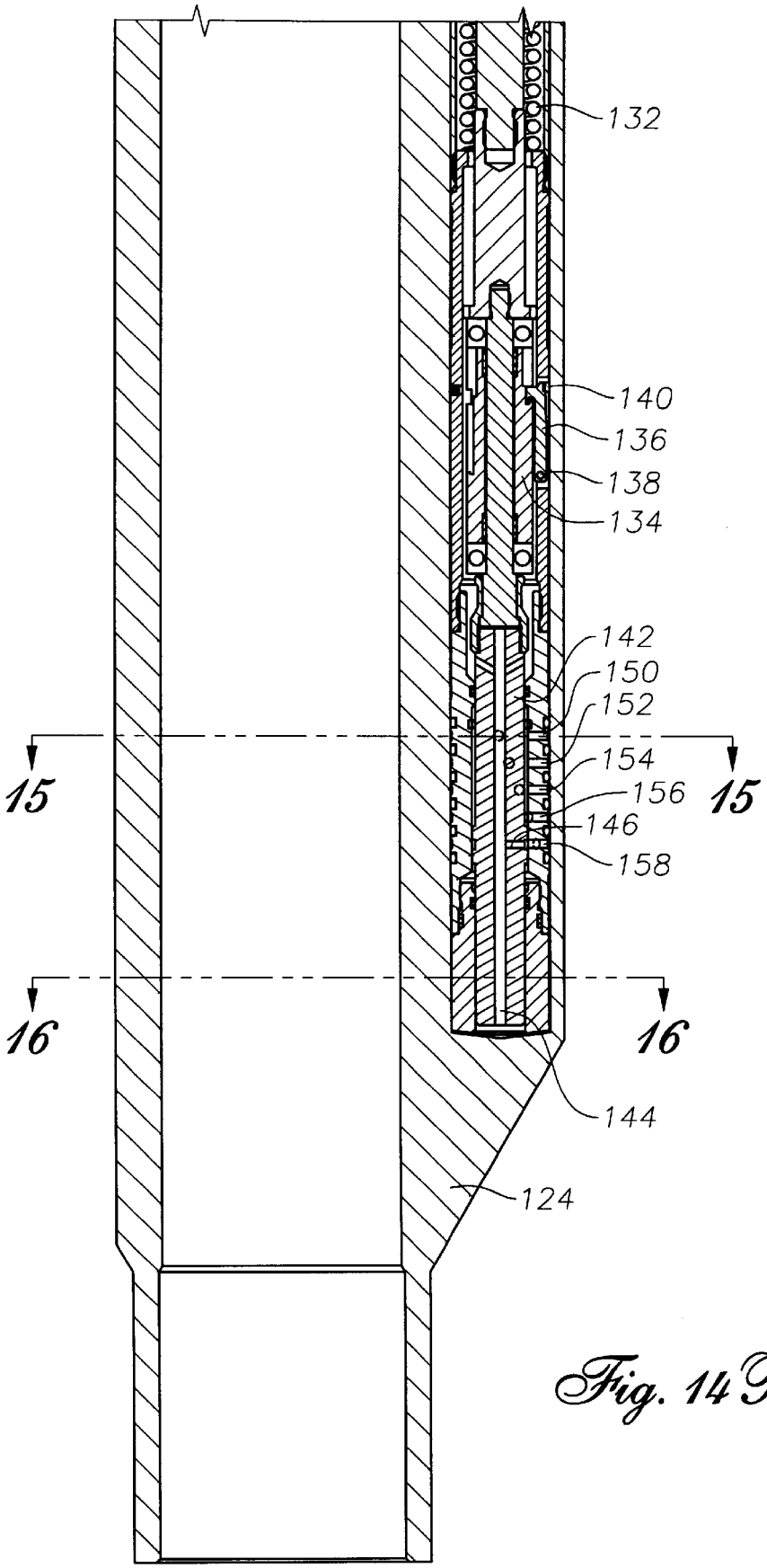
Figure 15:
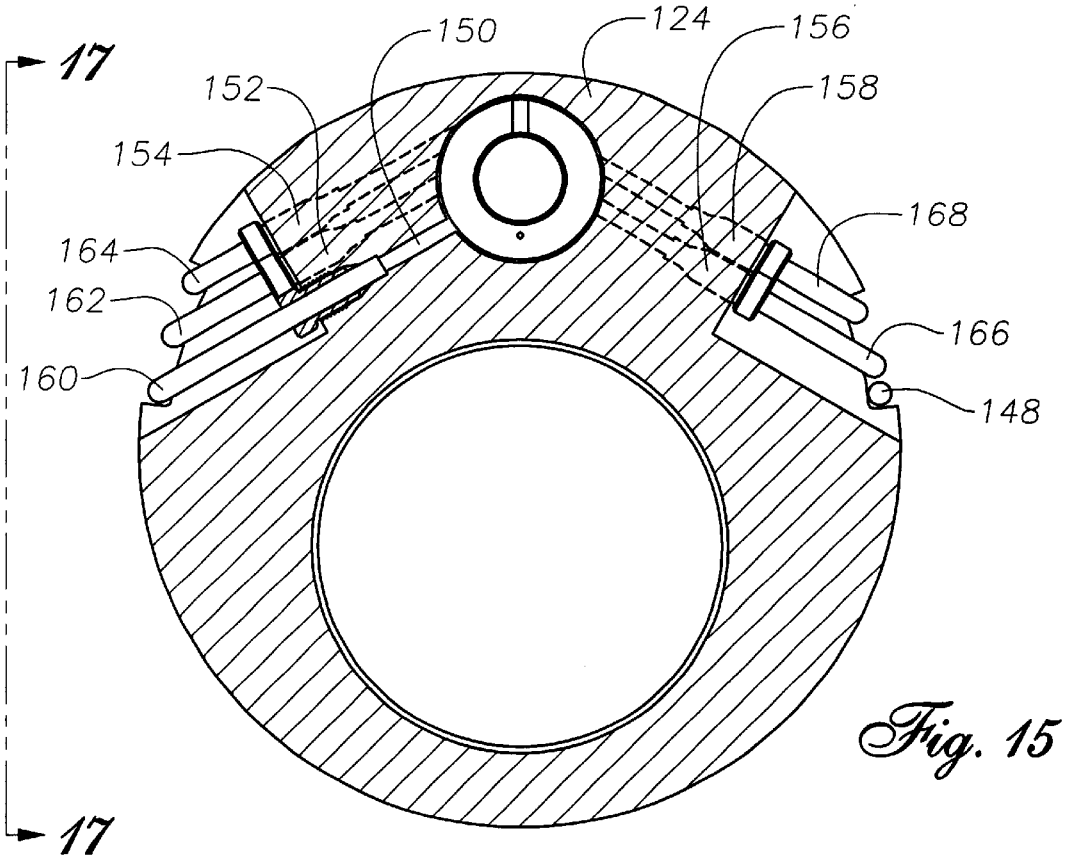
FIG. 15 is a cross-sectional view taken along line 15—15 of FIGS. 14B and 20B.
Figure 16:
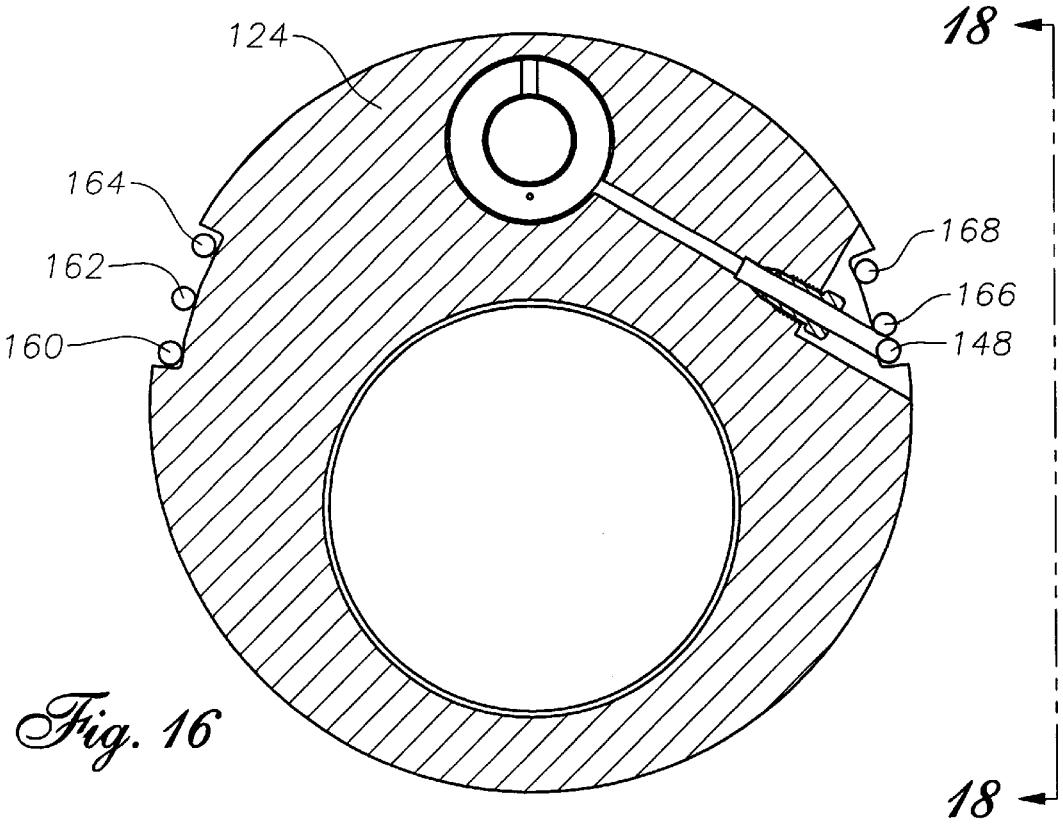
FIG. 16 is a cross-sectional view taken along line 16—16 of FIG. 14B and 20B.
Figure 17:
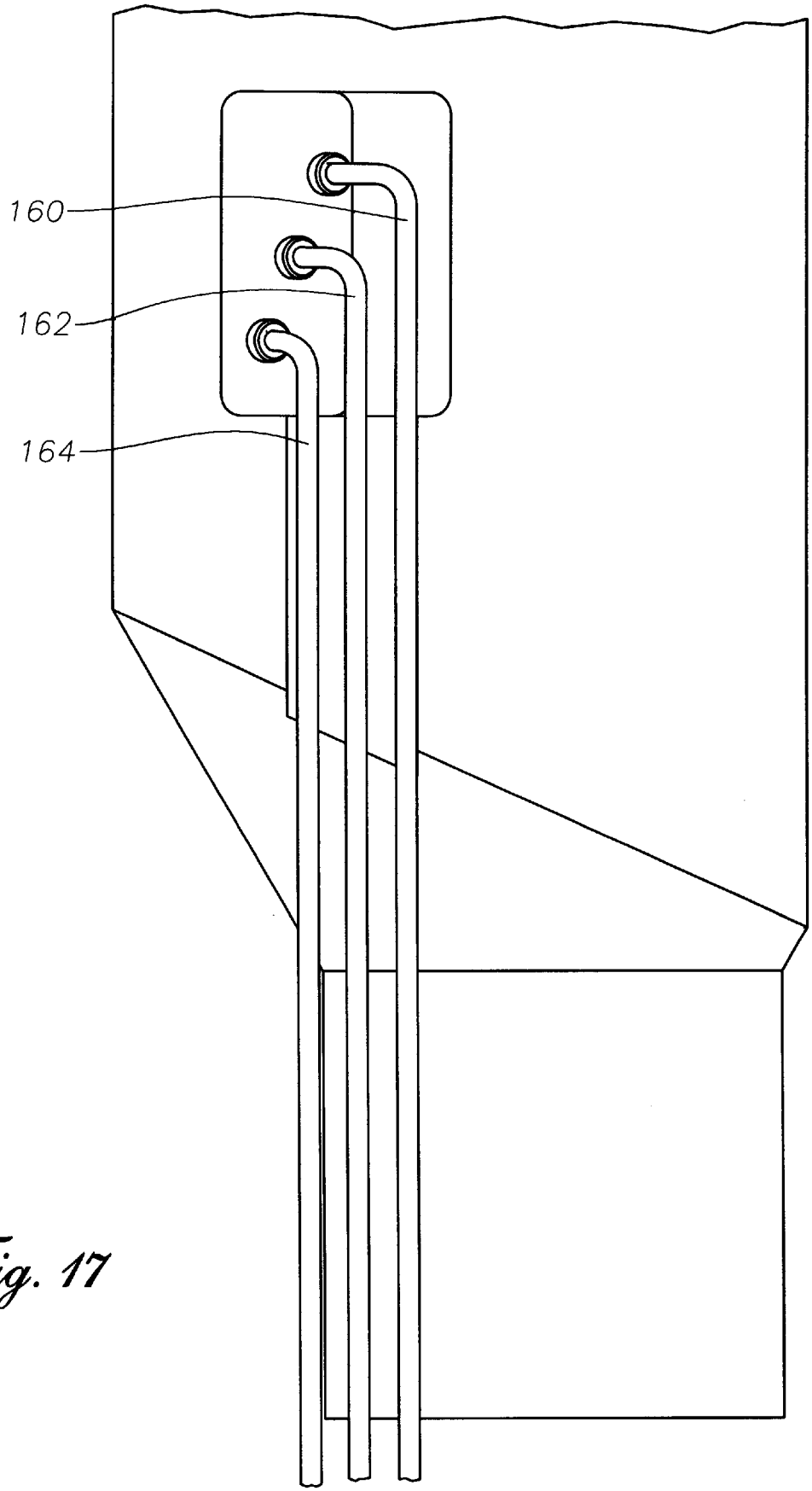
FIG. 17 is a partial elevation view taken along line 17—17 of FIG. 15.
Figure 18:
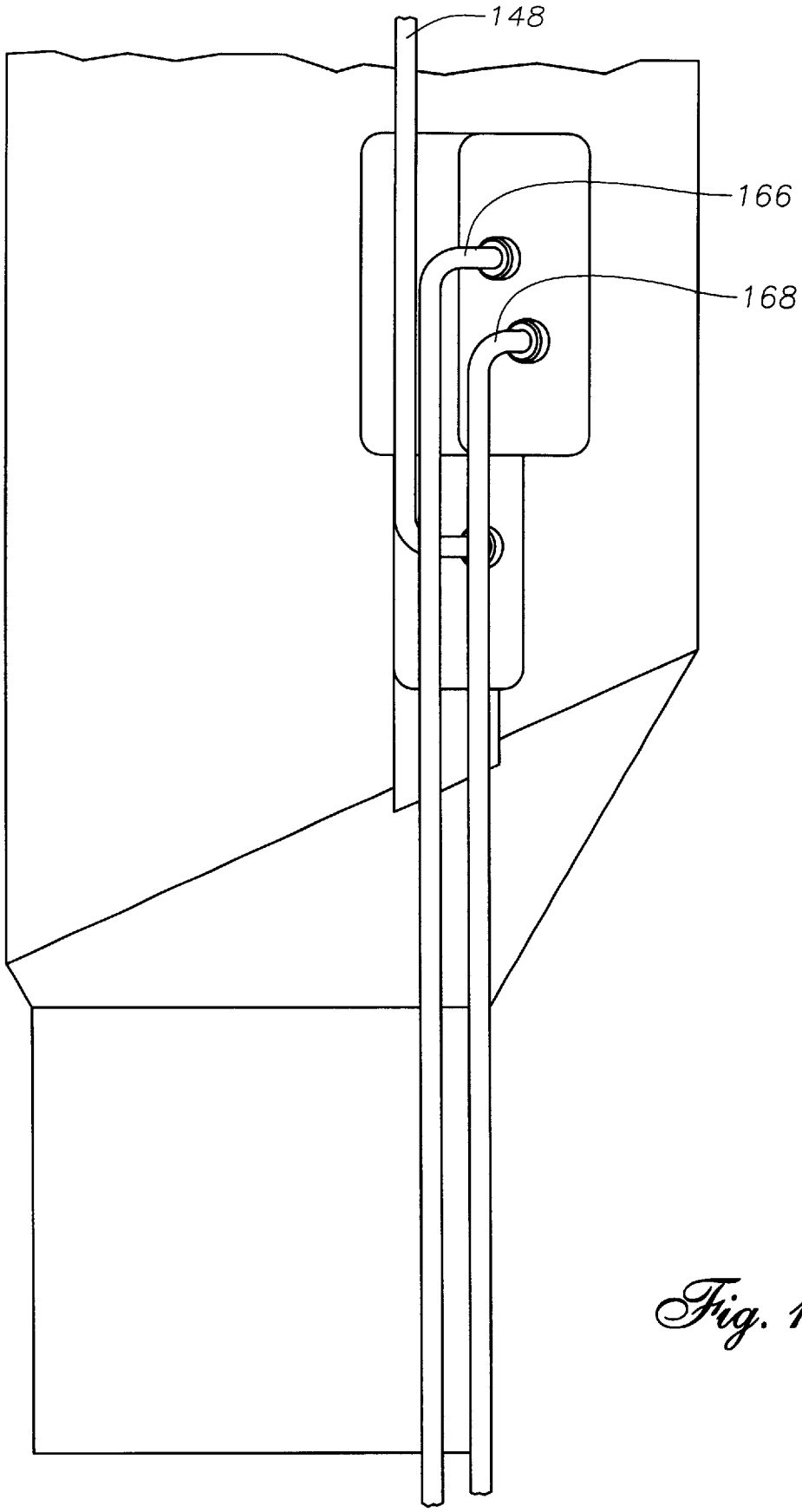
FIG. 18 is a partial elevation view taken along line 18—18 of FIG. 16.

Referring now to FIGS. 14A and 14B, another specific embodiment of a downhole valve 122 of the present invention is illustrated. As shown in FIG. 14A, the valve 122 includes a valve body 124 that is connected to a first fluid supply line 126 at a first end 128 of the valve body 124. The first fluid supply line 126 is connected to a source of pressurized fluid (not shown) and is in fluid communication with a piston 130 that is disposed for longitudinal movement within the valve body 124 in response to pressurized fluid in the first fluid supply line 126. A spring 132 is disposed within the valve body 124 to oppose the force exerted on the piston 130 by the pressurized fluid in the first fluid supply line 126 and to bias the piston 130 toward the first end 128 of the valve body 124. In an alternative embodiment, a nitrogen charge and/or a balance line, such as disclosed elsewhere herein, may be provided to assist or replace the spring to bias the piston 130 toward the first end 128 of the valve body 124. Referring now to FIG. 14B, the piston 130 is connected to a cammed indexer 134 of the type discussed above and illustrated in FIGS. 5–7. The indexer 134 is engaged with a retaining member 136. In a specific embodiment, the retaining member 136 may be an L-shaped hook hingedly attached to the valve body 124 about a pin 138 and biased into engagement with the indexer 134 by a spring strap 140. The indexer 134 is connected to a fluid transfer member 142 which includes at least one fluid channel therethrough. In this specific embodiment, the at least one fluid channel may be established through a longitudinal bore 144 through the fluid transfer member 142, the longitudinal bore 144 being in fluid communication with an axial bore 146. As best shown in FIG. 16, which is a cross-sectional view taken along line 16—16 of FIG. 14B, and also in FIG. 18, which is a partial elevational view taken along line 18—18 of FIG. 16, the valve body 124 is connected to a second fluid supply line 148, which is connected to a source of pressurized fluid (not shown). As best shown in FIG. 14B, the second fluid supply line 148 is in fluid communication with the longitudinal bore 144 through the fluid transfer member 142.

The valve 122 further includes at least one fluid outlet port. In this specific embodiment, as shown in FIG. 14B, the valve 122 includes five fluid outlet ports, namely a first fluid outlet port 150, a second fluid outlet port 152, a third fluid outlet port 154, a fourth fluid outlet port 156, and a fifth fluid outlet port 158. As shown in FIGS. 15 through 18, the first outlet port 150 is in fluid communication with a first fluid transfer conduit 160, the second outlet port 152 is in fluid communication with a second fluid transfer conduit 162, the third outlet port 154 is in fluid communication with a third fluid transfer conduit 164, the fourth outlet port 156 is in fluid communication with a fourth fluid transfer conduit 166, and the fifth outlet port 158 is in fluid communication with a fifth fluid transfer conduit 168. Each of the transfer conduits 160–168 may be connected to a variety of pressure-actuated downhole well tools (not shown). As explained above in connection with FIGS. 1–4 and 8–10, the present invention is not intended to be limited to a valve having any particular number of fluid outlet ports.

The valve 122 may further include a pressure transducer 123 for sensing the pressure of fluid entering the valve 122 through the first fluid supply line 126. The transducer 123 may be connected to the supply line 126 outside of the valve 122, or it may be located on the valve body 124 between the piston 130 and the first end 128 of the valve body 124, as shown in FIG. 14A. The transducer 123 is connected to a fiber decode unit 127 at the earth's surface by a conductor cable 125. In a specific embodiment, the transducer 123 may be a fiber optic Braggrate-type pressure transducer, and the conductor cable 125 may be a fiber optic cable. The fiber decode unit 127 converts the signal being transmitted via the fiber optic cable 125 into an electric signal, which is transmitted to a control module 129, in a manner known in the art. The control module 129 may include an electric circuit or a computer loaded with software, and is designed to convert the signal coming from the fiber optic decode unit 127 into a readout showing the position of the indexer 134. The purpose of providing a readout to the operator at the earth's surface of the hydraulic pressure at the valve 122 is to provide an indication of the position of the fluid transfer member 142 (FIG. 14B), which will tell the operator which outlet port 150–158 is being supplied with pressurized fluid from the second fluid supply line 148. The control module 129 is equipped with the appropriate controls, circuitry, computer, etc. to convert the pressure reading to a signal indicating which outlet port 150–158 is activated, as will be readily understood by those of ordinary skill in the art.

In operation, a pressure oscillation is introduced into the first fluid supply line 126 (FIG. 14A) to move the piston 130 to index the indexer 134, which is biased toward the first end 128 of the valve body 124 by the spring 132. In the manner explained above in connection with FIGS. 1–7, the indexer 134 and the retaining member 136 cooperate to locate and hold the fluid transfer member 142 in a plurality of discrete positions. In this manner, an operator at the earth's surface may remotely select which outlet port 150–158 is in fluid communication with the second fluid supply line 148, and thereby selectively apply pressure through one of the fluid transfer conduits 160–168 to a selected pressure-actuated downhole well tool (not shown). FIG. 14B illustrates the fluid transfer member 142 positioned so as to align the axial bore 146 with the fifth fluid outlet port 158. In this position, pressurized fluid is delivered from the second fluid supply line 148 through the longitudinal bore 144, through the axial bore 146, through the fifth fluid outlet port 158, and through the fifth fluid transfer conduit 168 to a downhole well tool (not shown).

Figure 19A:
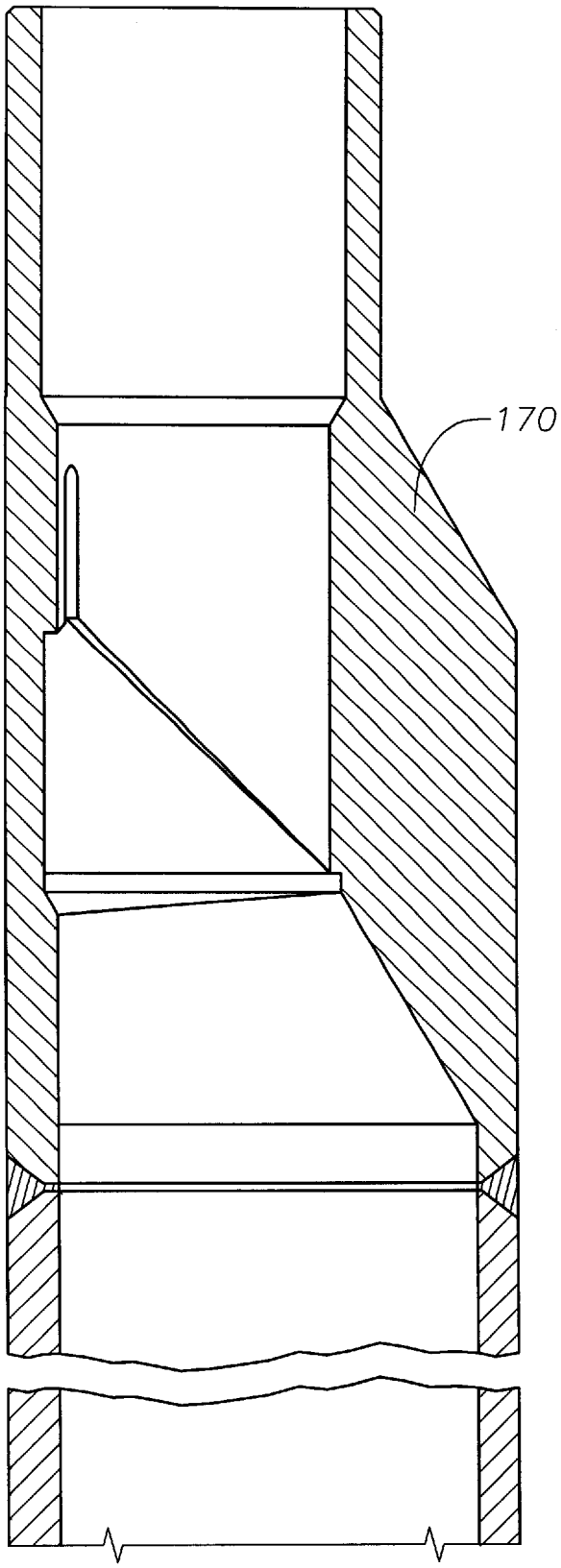
FIGS. 19A through 19D are elevation views which together show a wireline-retrievable downhole valve of the present invention, with a single hydraulic oscillation line, a single hydraulic pressure input line and five hydraulic pressure output lines, retrievably positioned in a side pocket mandrel.
Figure 19B:
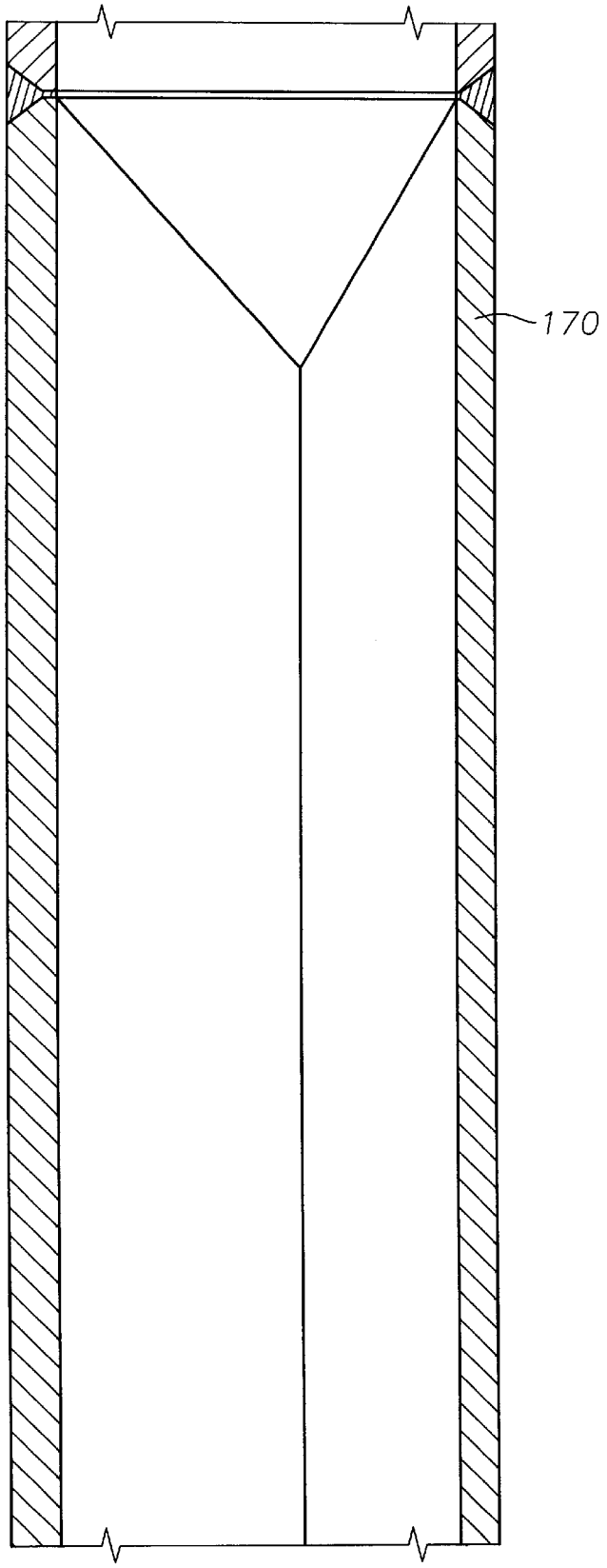
Figure 19C:
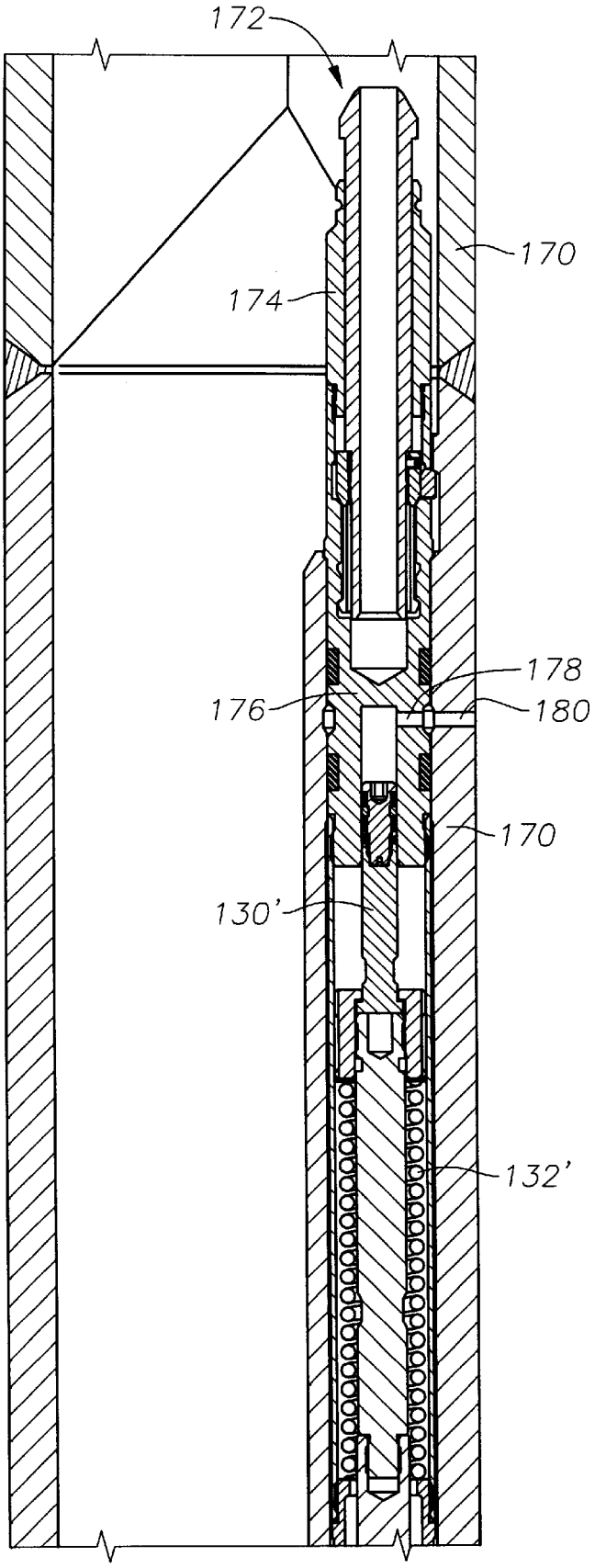
Figure 19D:
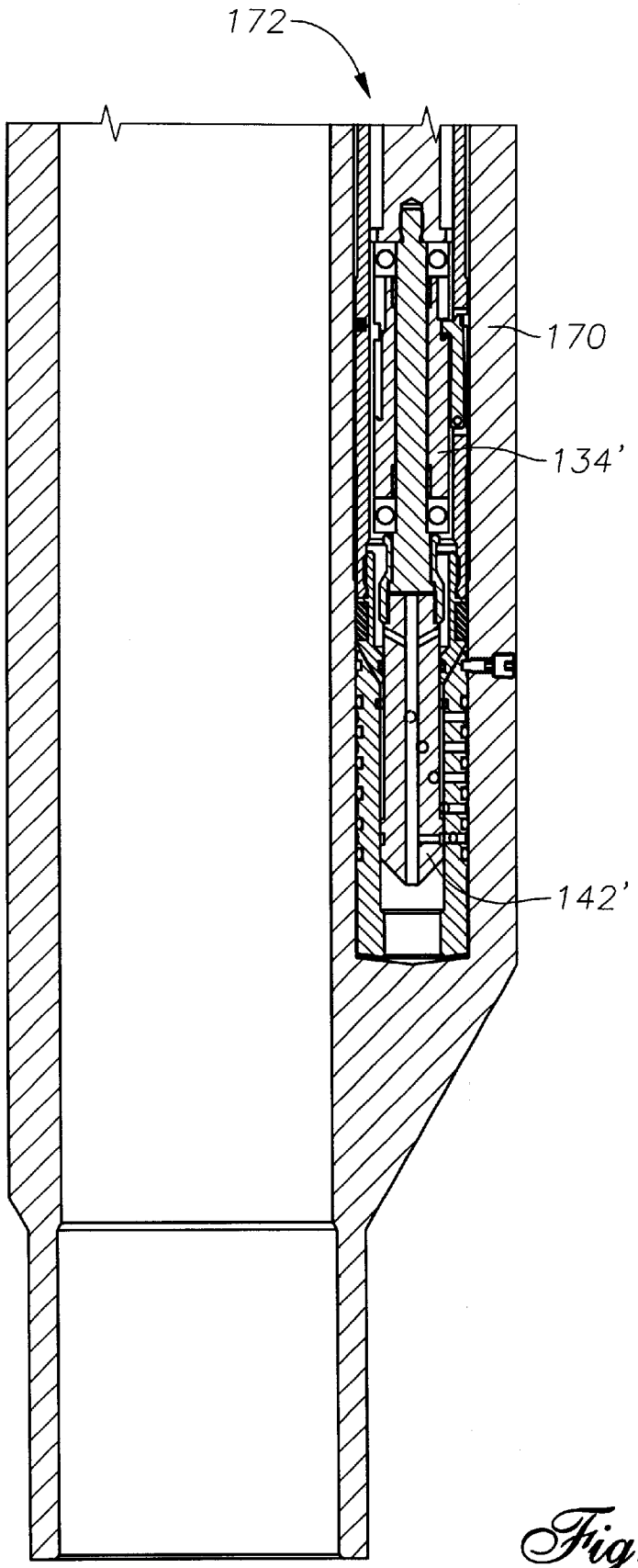

As explained above, the downhole valve of the present invention may be provided in a variety of configurations. For example, it may be a stand-alone tool, as shown in FIGS. 1–4 and 8–10, it may be provided as an integral component of a downhole well tool, such as a subsurface safety valve (see FIGS. 11 and 12), or it may also be retrievably located within a downhole tool, either by wireline or by tubing, such as, for example, in a side-pocket mandrel (see FIG. 13). In this regard, with reference to FIGS. 19A through 19D, a slightly modified version of the specific embodiment of the downhole valve 122 illustrated in FIGS. 14 through 18 is shown located in a side-pocket mandrel 170. Referring to FIGS. 19C and 19D, a specific embodiment of a downhole valve of the present invention is referred to generally by the numeral 172. As stated above, this embodiment of the valve 172 is very similar to the valve 122 shown in FIGS. 14–18, with one of the differences being that the valve 172 shown here is provided with a latching mechanism 174 for mating with a wireline tool (not shown) to enable an operator at the earth's surface to remotely retrieve and/or install the valve 172, in a manner well known to those of ordinary skill in the art. In this specific embodiment the valve 172 includes a valve body 176 having a first fluid inlet port 178 in fluid communication with a piston 130'. When the valve 172 is installed in the side pocket mandrel 170, the fluid inlet port 178 is aligned with a second fluid inlet port 180 located through the wall of the side pocket mandrel 170. The second fluid inlet port 180 is connected to a first fluid supply line (not shown) that is connected to a source of pressurized fluid (not shown). The valve 172 further includes a spring 132', a multiple-position indexer 134', and a fluid transfer member 142'. With the exception of the above-noted differences, the structure and operation of the valve 172 shown here is similar to that of the valve 122 shown in FIGS. 14A–14B.

Figure 20A:
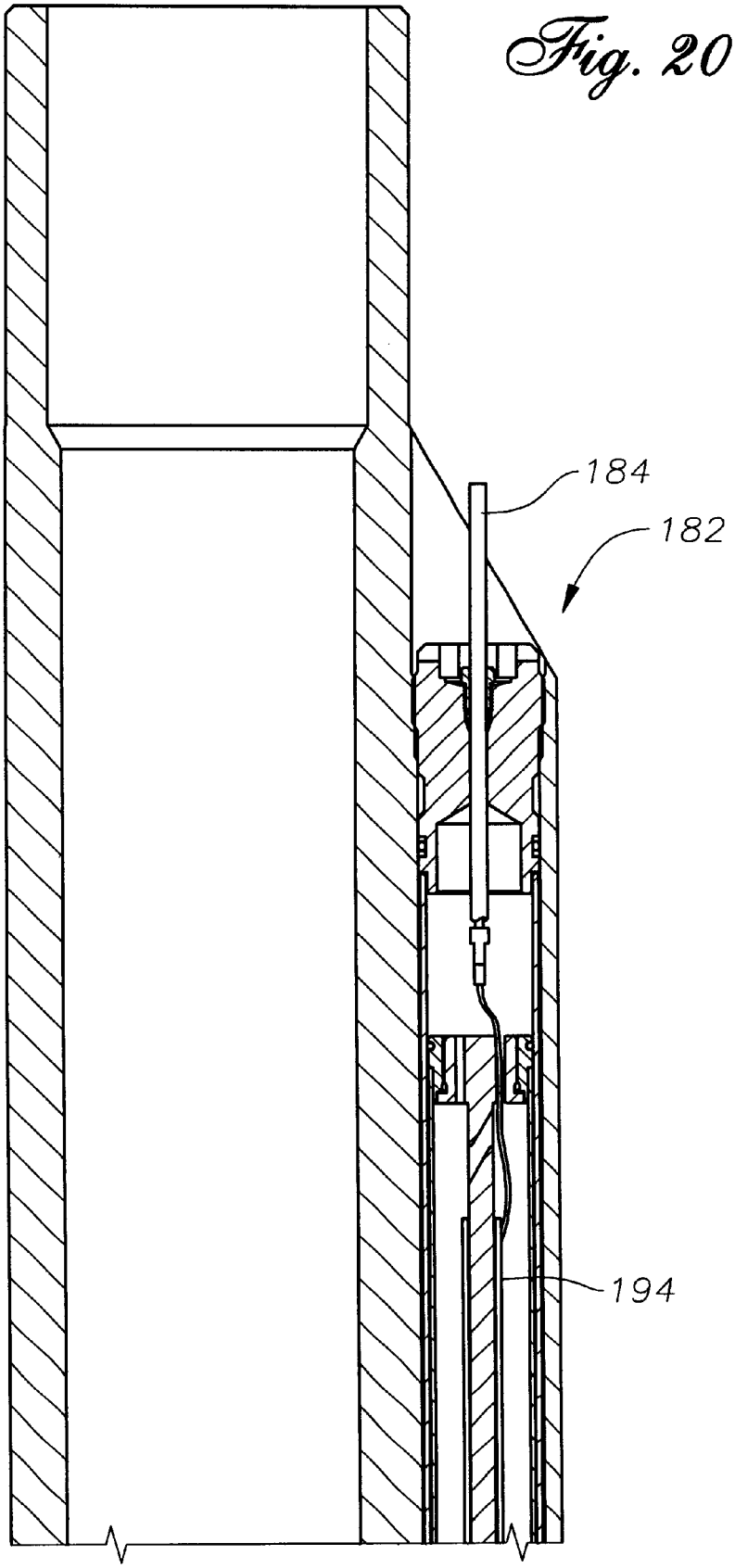
FIGS. 20A and 20B are elevation views which together show a tubing-deployed downhole valve of the present invention, with a single electric control line, a single hydraulic pressure input line and five hydraulic pressure output lines.
Figure 20B:
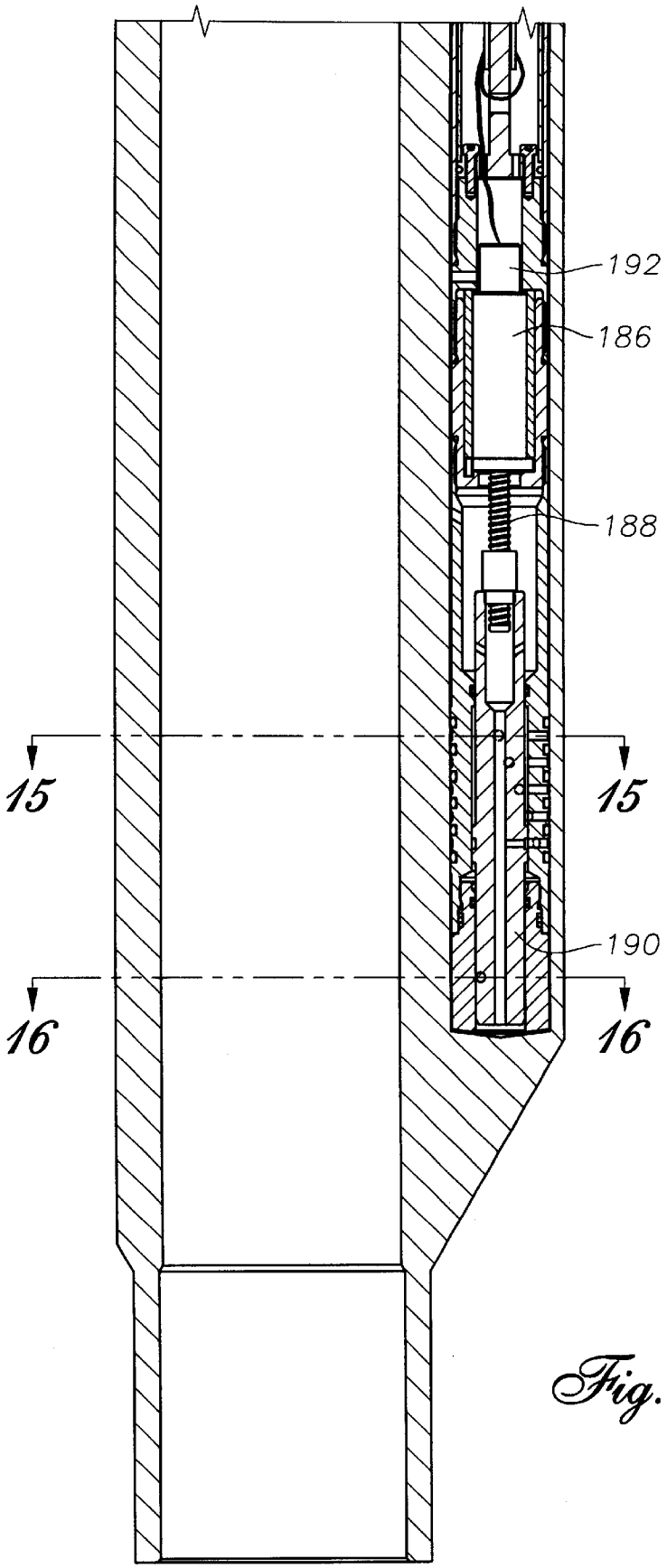

In another specific embodiment, instead of using a hydraulically-actuated indexing mechanism to move the fluid transfer member 18, 142, 142' to a plurality of discrete positions to selectively direct pressurized fluid from the second fluid supply line 38, 148 to any number of downhole well tools, an electrically-controlled indexing system is provided, as shown in FIGS. 20A and 20B. With reference to FIG. 20A, a specific embodiment of the downhole valve of the present invention is denoted by the numeral 182. In this embodiment, the valve 182 is connected to an electrical cable 184 that is connected to a source of electricity (not shown), such as at the earth's surface or on a downhole well tool (not shown). The cable 184 may include a plurality of electrical conductors. A motor 186 is disposed within the valve 182 and is connected to the electrical cable 184. In a specific embodiment, the motor 186 may be a stepper motor. A linear actuator 188 is connected to the motor 186 and is moveable in response to actuation of the motor 186. The linear actuator 188 is also connected to a fluid transfer member 190, the structure and operation of which is as described above for the fluid transfer member 142 shown in FIG. 14B. In a specific embodiment, the linear actuator 188 may be a threaded rod that is threadably connected to the fluid transfer member 190 so that rotation of the threaded rod will cause longitudinal movement of the fluid transfer member 190. In this manner, pressurized fluid may be selectively applied through the fluid transfer member 190 to one or more downhole well tools (not shown).

In a specific embodiment, the valve 182 may also include a position indicator 192 connected to the motor 186. The position indicator 192 will provide a signal to a control panel (not shown) at the earth's surface to indicate the position of the linear actuator 188, and thereby provide an indication of the position of the fluid transfer member 190. In this manner, the operator at the earth's surface will know which downhole well tool (not shown) is being supplied with pressurized fluid, and will enable the operator to select which particular downhole well tool (not shown) is to be actuated. In a specific embodiment, the position indicator 192 may be a rotary variable differential transformer (RVDT). In a specific embodiment, the RVDT 192, the motor 186, and the linear actuator 188 may be an integral unit, of the type available from Astro Corp., of Dearfield, Fla., such as Model No. 800283. In another specific embodiment, the position indicator 192 may be an electromagnetic tachometer. In another specific embodiment, if the motor 186 is a stepper motor, the position indicator 192 may be a step counter for counting the number of times the stepper motor 186 has been advanced. In another specific embodiment, the position indicator 192 may be an electrical resolver. In a specific embodiment, the valve 182 may further include an electronic module 194 connected between the electrical cable 184 and the motor 186 to control operation of the motor 186.

Figure 21:
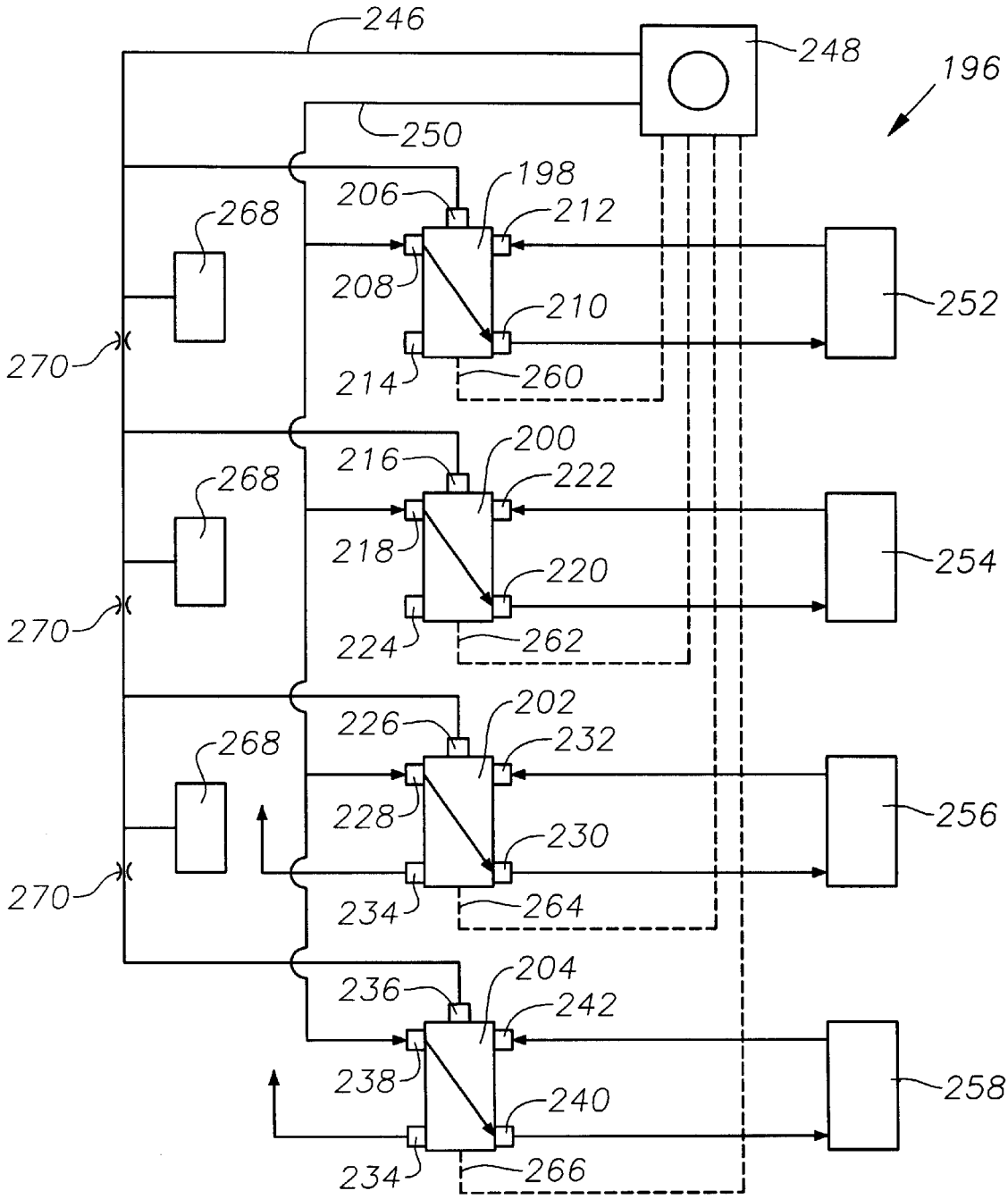
FIG. 21 is a schematic representation of a downhole well control system employing a plurality of downhole valves of the present invention.

One of ordinary skill in the art will immediately recognize that the various above-described embodiments of the downhole valve of the present invention may be used in a variety of configurations. For example, as shown in FIG. 21, a downhole well control system 196 may employ a plurality of downhole valves 198–204 to control a plurality of pressure-actuated downhole well tools. In a specific embodiment, the system 196 may include a first valve 198, a second valve 200, a third valve 202, and a fourth valve 204. Each valve 198–204 may be of the type described above and shown in FIGS. 1–19. The first valve 198 may include a first pilot port 206, a first inlet port 208, a first outlet port 210, a first return port 212, a first exhaust port 214, and may be shiftable in response to a pressure oscillation having a first magnitude (e.g., 1000 p.s.i.). The second valve 200 may include a second pilot port 216, a second inlet port 218, a second outlet port 220, a second return port 222, a second exhaust port 224, and may be shiftable in response to a pressure oscillation having a second magnitude (e.g., 2000 p.s.i.), the second magnitude being greater than the first magnitude. The third valve 202 may include a third pilot port 226, a third inlet port 228, a third outlet port 230, a third return port 232, a third exhaust port 234, and may be shiftable in response to a pressure oscillation having a third magnitude (e.g., 3000 p.s.i.), the third magnitude being greater than the second magnitude. The fourth valve 204 may include a fourth pilot port 236, a fourth inlet port 238, a fourth outlet port 240, a fourth return port 242, a fourth exhaust port 244, and may be shiftable in response to a pressure oscillation having a fourth magnitude (e.g., 4000 p.s.i.), the fourth magnitude being greater than the third magnitude. A first fluid supply line 246 may be connected to at least one source of pressurized fluid, such as within a control panel 248 at the earth's surface, and may be connected to each of the valves 198–204 at their respective pilot ports 206, 216, 226, and 236. A second fluid supply line 250 may be connected to the at least one source of pressurized fluid and to each of the valves 198–204 at their respective inlet ports 208, 218, 228, and 238. The first valve 198 is connected to a first downhole well tool 252, the second valve 200 is connected to a second downhole well tool 254, the third valve 202 is connected to a third downhole well tool 256, and the fourth valve 204 is connected to a fourth downhole well tool 258.

In operation, a pressure oscillation of the first magnitude may be sent through the first fluid supply line 246 to index a first fluid transfer member within the first valve 198 to a first discrete position to (a) distribute pressurized fluid in the second fluid supply line 250 through the first outlet port 210 to the first downhole well tool 252 and (b) prevent fluid flow from the first downhole well tool 252 into the first return port 212. Another pressure oscillation of the first magnitude may then be sent through the first fluid supply line 246 to index the first fluid transfer member within the first downhole valve 198 to a second discrete position to (a) prevent fluid flow from the second fluid supply line 250 through the first outlet port 210 and (b) vent pressurized fluid from the first downhole well tool 252 into the first return port 212 and through the first exhaust port 214. In this manner, the first valve 198 may be toggled back and forth to apply and bleed pressure from the first downhole well tool 252 without actuating or deactuating the other downhole well tools 254, 256, and 258. A signal may be transmitted over a first conductor cable 260 to the control panel 248 to provide an indication to an operator at the earth's surface as to whether pressure is being applied to or vented from the first downhole well tool 252.

To operate the second downhole well tool 254, a pressure oscillation of the second magnitude may then be sent through the first fluid supply line 246 to index a second fluid transfer member within the second valve 200 to a first discrete position to (a) distribute pressurized fluid in the second fluid supply line 250 through the second outlet port 220 to the second downhole well tool 254 and (b) prevent fluid flow from the second downhole well tool 254 into the second return port 222. Note that the pressure oscillation of the second magnitude will toggle both the first valve 198 in addition to toggling the second valve 200. It will be readily apparent to one of ordinary skill in the art that the third and fourth valves 202 and 204 may be toggled in like manner to actuate and deactuate the third and fourth downhole tools 256 and 258, respectively. The system 196 if further provided with second, third, and fourth conductor cables 262, 264, 266 to provide signals to the control panel 248 to provide an indication to an operator at the earth's surface as to whether pressure is being applied to or vented from the second, third, or fourth downhole well tools 254, 256, or 258, respectively. The first fluid supply line 246 may further include one or more accumulators 268 and/or chokes 270 to prevent the pressure oscillations from chattering the valves 198–204, as will be readily understood by one of ordinary skill in the art.

Figure 22:
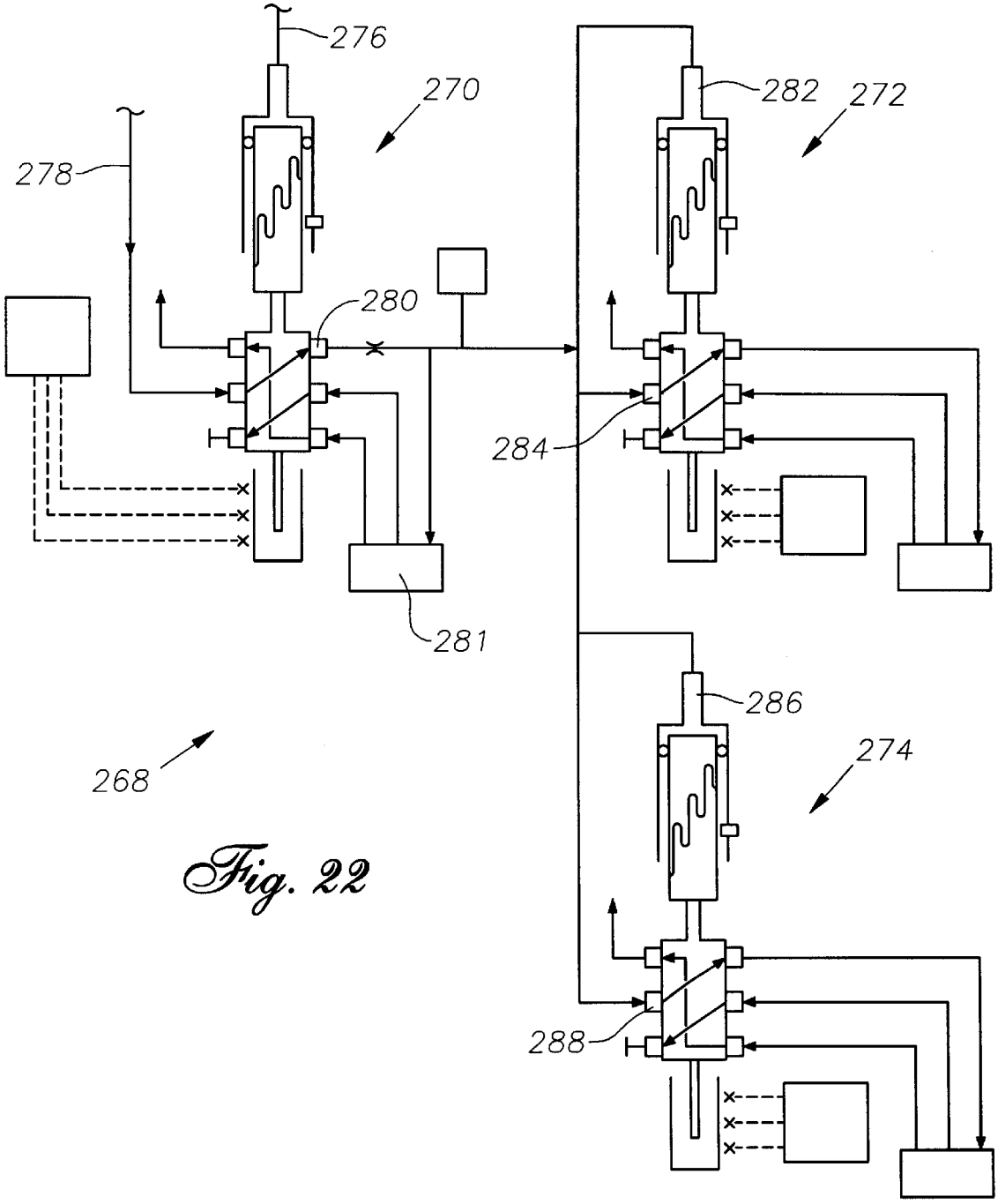
FIG. 22 is a schematic representation of a downhole well control system employing a plurality of downhole valves of the present invention.

Another example illustrating the numerous possible configurations of a well control system employing a plurality of the downhole valves of the present invention is shown in FIG. 22, which illustrates the use of downhole valves in series and parallel relationship. The system 268 shown in FIG. 22 includes a first, a second, and a third three-position downhole valve 270, 272, and 274. The first valve 270 is connected to a pilot line 276 and a main supply line 278. As shown in FIG. 22, the valve 270 is positioned to direct pressurized fluid from the main supply line 278 to a first output port 280. Pressurized fluid is then directed from the first output port 280 to (1) a first downhole tool 281, (2) a pilot port 282 and an inlet port 284, both on the second valve 272, and (3) a pilot port 286 and an inlet port 288, both on the third valve 274. Each valve 270–274 is designed to index at a pressure oscillation having a first, second, and third magnitude, respectively. The first magnitude is greater than the second magnitude, and the second magnitude is greater than the third magnitude.

In the configurations discussed above, the multiplexer valve of the present invention is used to remotely control the application and venting of pressurized fluid to and from a plurality of downhole pressure-actuated well tools. In addition to this broad use, the multiplexer valve of the present invention may also be used to remotely control the injection of chemicals (or corrosion inhibitors) into a plurality of production zones in a well having multiple lateral well bores. As is well known to those of ordinary skill in the art, when injecting chemicals into a well for the purpose of combating corrosion, it is preferred that the chemicals be injected at the lowermost portion, or bottom, of the well so that they may become entrained in the production fluids and coat the entirety of the inner surface of the production tubing and well tools as the production fluid-chemical mixture is produced to the surface. As such, a chemical injection line is connected between the earth's surface and a chemical injector valve placed at the bottom of the well to enable an operator at the earth's surface to remotely inject chemicals at the bottom of the well. However, when producing from a well having multiple lateral well bores, the well completion will have a number of distinct production zones. As such, the "bottom of the well" will vary depending on which production zone is being produced. One approach to providing the ability to inject chemicals in each production zone is to position a chemical injection valve in each production zone and run a separate chemical injection line from the surface to each chemical injection valve. This approach can become quite expensive. By use of the multiplexer valve of the present invention, however, the ability to inject chemicals into each production zone can be provided with a single multiplexer and a single chemical injection line. Alternatively, the ability to inject chemicals into each production zone may be provided with a single multiplexer, a single chemical injection line, and a single hydraulic control line.

For example, any of the above embodiments of the multiplexer valve of the present invention (e.g., the valve 10 shown in FIGS. 1–4, the valve 11 shown in FIGS. 8–10, the valve 122 shown in FIGS. 14A–14B, etc.) may be provided as part of a well completion, in any manner as discussed hereinabove (e.g., tubing deployed, wireline retrievable, etc.), and at any position in the well completion. For example, the valve may be positioned above the uppermost packer in the completion, i.e., above all of the multiple production zones. Alternatively, the valve may be placed within any of the production zones, or the valve may be placed below all of the production zones. Irrespective of the position of the valve, there will be an injection chemical supply line connected to the valve (e.g., the second fluid supply line 27 in FIGS. 8–10) for supplying the injection chemicals from the earth's surface to the well, and there may also be another fluid supply line for moving the valve between its various positions (e.g., the first fluid supply line 17 in FIGS. 8–10). As explained above, the pressurized fluid for moving the valve between its various positions may be supplied from a separate fluid supply line running from the earth's surface (e.g., the first fluid supply line 17 in FIGS. 8–10), or it may be supplied from the main fluid supply line (e.g., the second fluid supply line 27 in FIGS. 8–10). In this latter instance, where there is only one fluid supply line running from the earth's surface to the valve (i.e., the main fluid supply line or injection chemical line) the valve will be moved between its various positions in response to pressurized corrosion-inhibiting chemicals (e.g., diesel fuel). In the event that the electrically-piloted embodiment of the present invention is used (see FIGS. 20A–20B), there will be two lines running from the earth's surface to the valve, namely, an electrical cable and a chemical injector line.

Irrespective of the particular embodiment of the present invention used in this chemical-injection configuration, and irrespective of its particular location in the completion, the valve will include at least one outlet port for each of the desired injection locations (i.e, for each of the production zones). In addition, there will be a separate line or conduit running from each outlet port to each of the production zones, unless the valve is located within one of the production zones, in which case no separate conduit will be needed for that production zone—the chemicals can simply be distributed into that production zone straight from the outlet port designated for that production zone. The valve of the present invention may be remotely and selectively controlled, as described in detail above, to send injection chemicals to the appropriate zone, depending on which zone is being produced. As just one of many possible specific embodiments of a well completion using the multiplexer of the present invention to control the injection of chemicals into multiple production zones, reference is now made to the well completion shown in FIG. 24.

Figure 24:
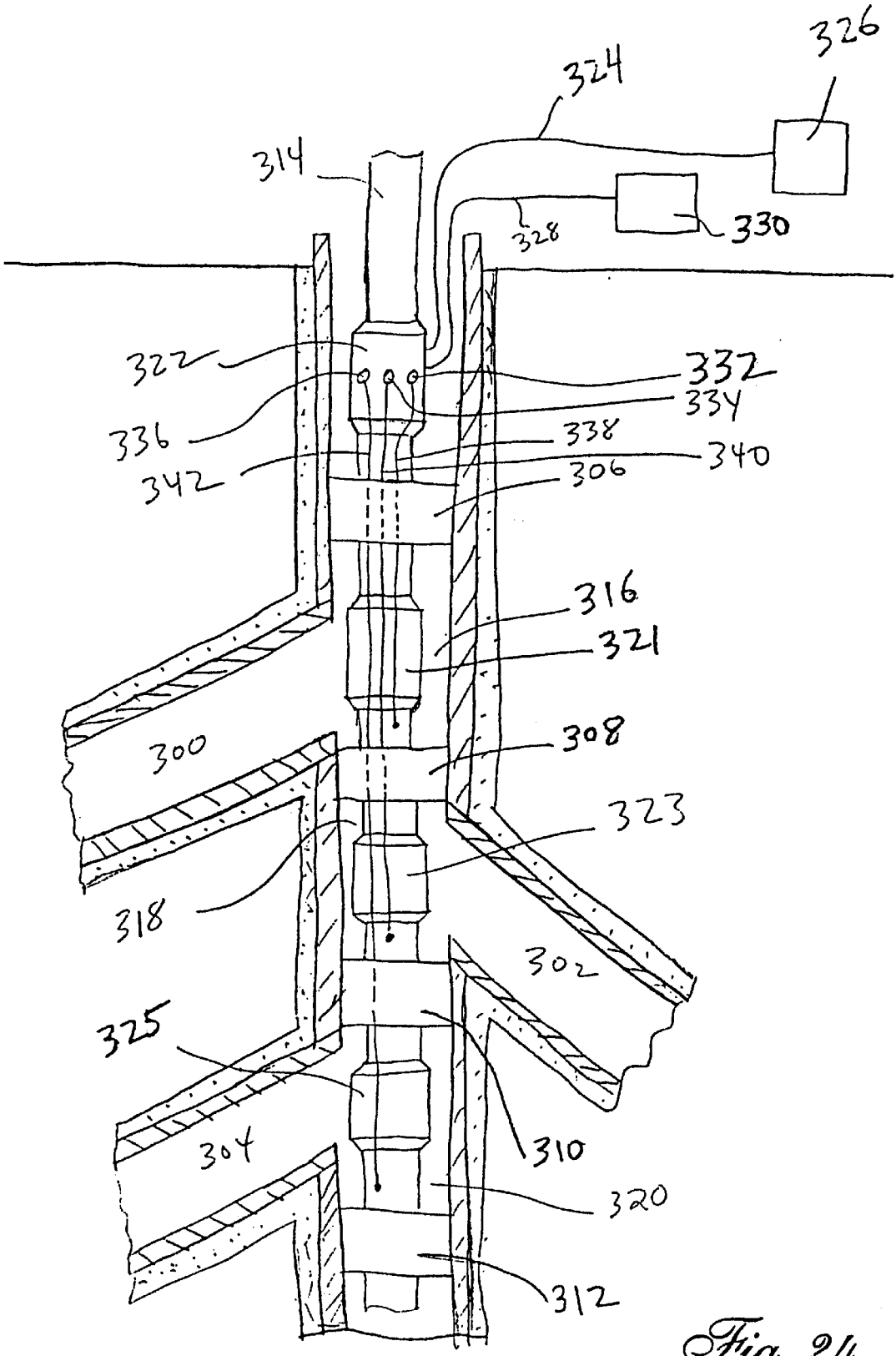
FIG. 24 illustrates a well completion incorporating the multiplexer of the present invention to remotely and selectively distribute corrosion inhibiting chemicals to any number of production zones associated with a well having multiple lateral well bores.

FIG. 24 illustrates a well completion disposed in a well having multiple (first, second, and third) lateral well bores 300, 302, and 304. The well completion includes first, second, third, and fourth packers 306,308,310, and 312, each of which is connected to a production tubing 314. The first and second packers 306 and 308 define a first production zone 316 associated with the first lateral well bore 300. The second and third packers 308 and 310 define a second production zone 318 associated with the second lateral well bore 302. The third and fourth packers 310 and 312 define a third production zone 320 associated with the third lateral well bore 304. The completion further includes first, second, and third flow control devices 321, 323, and 325, such as sliding sleeves, connected to the tubing 314 and located in each of the first, second, and third productions zones 316, 318, and 320, respectively. The completion further includes a multiplexer valve 322 connected to the tubing 314. As explained above, the valve 322 may be any of the embodiments discussed above. In this specific embodiment, the valve 322 is located above the uppermost packer 306, but this position should not be taken as a limitation, as explained above. A first fluid supply line 324 is connected between a source of pressurized fluid 326 at the earth's surface and the valve 322 to remotely move the valve 322 between its various positions. It is noted that if the valve 322 is the electrically-operated embodiment described above, the first supply line 324 will be an electrical cable and the source 326 will be a source of electricity. The completion further includes a second fluid supply line (or injection chemical line) 328 that is connected between a source of injection chemicals 330 at the earth's surface and the valve 322. In this specific embodiment, the valve 322 is provided with first, second and third outlet ports 332,334, and 336. A first conduit 338 leads from the first outlet port 332 to the first production zone 316, and preferably terminates at a point below the first flow control device 321 and just above the second packer 308. A second conduit 340 leads from the second outlet port 334 to the second production zone 318, and preferably terminates at a point below the second flow control device 323 and just above the third packer 310. A third conduit 342 leads from the third outlet port 336 to the third production zone 320, and preferably terminates at a point below the third flow control device 325 and just above the fourth packer 312. It is noted that the conduits 338–342 may terminate so as to dispense the injection chemicals into the well annulus and/or within the production tubing 314. It will be readily apparent to one of ordinary skill in the art, in view of the above disclosure and discussion of the various embodiments of the multiplexer of the present invention, that the multiplexer 322 may be used to remotely and selectively control the injection of corrosion inhibiting chemicals into each of the production zones 316–320, depending on which zone is being produced. It is emphasized again that the well completion shown in FIG. 24 is but one of many well completions in which the multiplexer of the present invention could be used to remotely and selectively inject chemicals into multiple production zones. The number of packers, production zones, flow control devices, lateral well bores, etc., shown in FIG. 24 are not intended to be and should not be taken as a limitation.

In another specific embodiment, in the event that more than one production zone is being produced at the same time, it may be desirable to provide the well completion with the ability to simultaneously inject chemicals into each zone being produced. In such event, the multiplexer 322 may include a plurality of the downhole valves of the present invention, in series and/or parallel combinations, such as shown, for example, in FIG. 23, discussed above.

It is to be understood that the invention is not limited to the exact details of construction, operation, exact materials or embodiments shown and described, as obvious modifications and equivalents will be apparent to one skilled in the art. Accordingly, the invention is therefore to be limited only by the scope of the appended claims.

What is claimed is:

1. A downhole valve comprising:

a valve body having a first fluid inlet port, a second fluid inlet port, a plurality of fluid outlet ports, and a retaining member, the first and second fluid inlet ports being connected to a fluid supply line, the fluid supply line being connected to at least one source of pressurized fluid;

a piston movably disposed within the valve body, a first end of the piston being in fluid communication with the fluid supply line and moveable in response to pressurized fluid therein;

position holder movably disposed within the valve body, connected to the piston, and engaged with the retaining member;

a fluid transfer member movably disposed within the valve body and having at least one fluid passageway, the fluid transfer member being connected to the piston and the position holder, the position holder and the retaining member cooperating to maintain the fluid transfer member in a plurality of discrete positions, the at least one fluid passageway establishing fluid communication between the fluid supply line and one of the plurality of fluid outlet ports for at least one of the plurality of discrete fluid-transfer-member positions; and, a mechanism adapted to bias the piston against the pressurized fluid in the fluid supply line.

2. The downhole valve of claim 1, wherein the fluid supply line includes a first fluid supply line and a second fluid supply line, the first fluid supply line being connected to the first fluid inlet port, the second fluid supply line being connected to the second fluid inlet port, the first end of the piston being in fluid communication with the first fluid supply line and moveable in response to pressurized fluid therein, the at least one fluid passageway establishing fluid communication between the second fluid supply line and one of the plurality of fluid outlet ports for at least one of the plurality of discrete fluid-transfer-member positions, and the biasing mechanism biasing the piston against the pressurized fluid in the first fluid supply line.

3. The downhole valve of claim 2, wherein the biasing mechanism includes a balance line connected to the second fluid supply line to bias the piston against the pressurized fluid in the first fluid supply line.

4. The downhole valve of claim 3, wherein the balance line further includes a pressure relief valve.

5. The downhole valve of claim 3, wherein the balance line further includes a choke and a accumulator.

6. The downhole valve of claim 1, wherein the fluid transfer member includes a plurality of fluid passageways, and the valve body further includes a plurality of fluid exhaust ports, at least one of which is in fluid communication through one of the plurality of fluid passageways with one of the fluid outlet ports, other than the fluid outlet port in fluid communication with the fluid supply line, for at least one of the plurality of discrete fluid-transfer-member positions.

7. The downhole valve of claim 6, wherein at least one of the plurality of fluid exhaust ports further includes a one-way check valve.

8. The downhole valve of claim 6, wherein at least one of the plurality of fluid exhaust ports further includes a pressure relief valve.

9. The downhole valve of claim 6, wherein at least one of the plurality of fluid exhaust ports further includes a filter.

10. The downhole valve of claim 1, further including at least one proximity sensor connected to a conductor for transmitting a signal to a remote control panel to indicate a position of the fluid transfer member.

11. The downhole valve of claim 10, wherein the at least one proximity sensor is a fiber optic sensor and the conductor is a fiber optic conductor cable.

12. The downhole valve of claim 10, wherein the at least one proximity sensor is a magnetic sensor and the conductor is a low voltage electrical insulated cable.

13. The downhole valve of claim 1, further including a pressure transducer connected to a conductor cable, the conductor cable transmitting a signal to a control panel, the signal representing the pressure of fluid within the first fluid supply line, the pressure signal indicating which of the plurality of fluid outlet ports is in fluid communication with the fluid supply line.

14. The downhole valve of claim 13, wherein the transducer is a fiber optic pressure transducer and the conductor cable is a fiber optic cable.

15. The downhole valve of claim 1, wherein the biasing mechanism includes a spring.

16. The downhole valve of claim 1, further including a gas chamber containing a volume of pressurized gas biasing the piston against the pressurized fluid in the fluid supply line.

17. The downhole valve of claim 1, wherein the biasing mechanism includes a balance line.

18. The downhole valve of claim 17, wherein the balance line is connected to a remote source of pressurized fluid.

19. The downhole valve of claim 1, further including a synchronizer at the earth's surface for monitoring and processing the number of hydraulic pulses applied to the downhole valve through the fluid supply line to provide an indication of the position of the shiftable valve member.

20. The downhole valve of claim 1, wherein the retaining member is a spring-loaded detent pin.

21. The downhole valve of claim 1, wherein the retaining member is a hook hingedly attached to the valve body about a pin and biased into engagement with the position holder by a spring.

22. The downhole valve of claim 1, wherein the piston, the position holder, and the fluid transfer member are an integral component.

23. The downhole valve of claim 1, wherein the fluid transfer member is a shuttle valve.

24. The downhole valve of claim 1, wherein the at least one fluid passageway through the fluid transfer member is a longitudinal bore through the fluid transfer member that is in fluid communication with an axial bore in the fluid transfer member.

25. The downhole valve of claim 1, wherein the fluid transfer member is fixedly connected to the position holder, whereby longitudinal movement of the piston will cause longitudinal and angular movement of the fluid transfer member.

26. The downhole valve of claim 1, wherein the fluid transfer member is rotatably connected to the position holder, whereby longitudinal movement of the piston will cause only longitudinal movement of the fluid transfer member.

27. The downhole valve of claim 1, wherein the valve is tubing-deployed.

28. The downhole valve of claim 1, wherein the valve is wireline-retrievable.

29. The downhole valve of claim 1, further including at least one downhole well tool in fluid communication with at least one of the plurality of fluid outlet ports.

30. The downhole valve of claim 29, wherein the at least one downhole well tool is a packer.

31. The downhole valve of claim 1, further including a plurality of downhole well tools in fluid communication with the plurality of fluid outlet ports.

32. A method of controlling a plurality of pressure-actuated downhole well tools comprising the steps of:

connecting a first fluid supply line from at least one source of pressurized fluid to a downhole valve;

connecting a second fluid supply line from the at least one source of pressurized fluid to the downhole valve; and, applying pressure through the first fluid supply line to the downhole valve to selectively establish fluid communication between the second fluid supply line and a plurality of downhole well tools.

33. A downhole apparatus comprising:

a fluid inlet port;

a plurality of fluid outlet ports;

a movable member movable among a plurality of discrete positions to selectively establish fluid communication between the fluid inlet port and at least one of the plurality of fluid outlet ports; and a piston in fluid communication with pressurized fluid through another fluid inlet port and adapted to shift the movable member among its plurality of discrete positions.

34. The downhole apparatus of claim 33, further including a spring adapted to bias the piston against the pressurized fluid.

35. The downhole apparatus of claim 33, further including a gas chamber containing a volume of pressurized gas adapted to bias the piston against the pressurized fluid.

36. The downhole apparatus of claim 33, further including a balance line adapted to bias the piston against the pressurized fluid.

37. The downhole apparatus of claim 33, further including a position holder engageable with the movable member and adapted to maintain the movable member in each of its plurality of discrete positions.

38. The downhole apparatus of claim 33, wherein the movable member includes at least one fluid passageway adapted to establish fluid communication between the fluid inlet port and the plurality of fluid outlet ports.

39. The downhole apparatus of claim 33, further including at least one downhole well tool in fluid communication with at least one of the plurality of fluid outlet ports.

40. The downhole apparatus of claim 39, wherein the at least one downhole is a packer.

41. The downhole apparatus of claim 39, wherein the at least one downhole well tool is a subsurface safety valve.

42. The downhole apparatus of claim 33, further including a plurality of downhole well tools in fluid communication with the plurality of fluid outlet ports.

43. The downhole apparatus of claim 42, wherein each of downhole well tools is in fluid communication with a different fluid outlet port.

* * * * *